US012295461B2

(12) United States Patent
Rasmussen et al.

(10) Patent No.: US 12,295,461 B2
(45) Date of Patent: May 13, 2025

(54) NATURAL-CUSHIONING, SOCK LINER APPARATUS AND METHOD

(71) Applicant: Nelwood Corp., Murray, UT (US)

(72) Inventors: Bret Rasmussen, Murray, UT (US); Cameron Braithwaite, Cottonwood Heights, UT (US)

( * ) Notice: Subject to any disclaimer, the term of this patent is extended or adjusted under 35 U.S.C. 154(b) by 90 days.

(21) Appl. No.: 16/775,608

(22) Filed: Jan. 29, 2020

(65) Prior Publication Data

US 2020/0245727 A1 Aug. 6, 2020

Related U.S. Application Data

(60) Provisional application No. 62/841,607, filed on May 1, 2019, provisional application No. 62/799,552, filed on Jan. 31, 2019.

(51) Int. Cl.

| | |
|---|---|
| ***A43D 31/04*** | (2006.01) |
| ***A43B 7/14*** | (2022.01) |
| ***A43B 7/142*** | (2022.01) |
| ***A43B 13/18*** | (2006.01) |
| ***A43B 17/00*** | (2006.01) |
| ***A43B 17/02*** | (2006.01) |

(52) U.S. Cl.

CPC ..... *A43D 31/04* (2013.01); *A43B 7/14* (2013.01); *A43B 7/142* (2013.01); *A43B 13/187* (2013.01); *A43B 13/188* (2013.01); *A43B 17/006* (2013.01); *A43B 17/02* (2013.01)

(58) Field of Classification Search

CPC ..... A43B 7/14; A43B 7/142; A43B 13/16; A43B 13/187; A43B 13/188; A43B 17/006; A43B 17/02; A43B 17/14

USPC ..... 36/43, 44, 88, 91, 92

See application file for complete search history.

(56) References Cited

U.S. PATENT DOCUMENTS

| | | | | |
|---|---|---|---|---|
| 2,070,814 A | | 2/1937 | Stemmons | |
| D113,620 S | | 3/1939 | Cairns | |
| 2,755,568 A | | 7/1956 | Menge | |
| D196,486 S | | 10/1963 | Papoutsy | |
| D201,864 S | | 8/1965 | Smith | |
| 4,268,980 A | * | 5/1981 | Gudas | A43B 7/141 36/43 |

(Continued)

FOREIGN PATENT DOCUMENTS

| | | | | |
|---|---|---|---|---|
| GB | 2442293 A | * | 4/2008 | A43B 1/0072 |
| GB | 2560022 A | * | 8/2018 | A43B 13/12 |
| KR | 100933531 B1 | * | 12/2009 | A43B 17/02 |

*Primary Examiner* — Aiying Zhao

(57) ABSTRACT

A sock liner (fitting above an insole of an article of footwear) includes a base layer between a thinner top layer, typically fabric contacting a sock in a shoe, and an intermediate layer below for shaping. The intermediate layer is a tailored series of projections, each extending from the medial side toward the lateral side. Together, these contain locally the individual regions of the "fat pad," extending along the underside of a foot, providing the natural cushioning of bones, muscles, tendons, and ligaments thereabove. The liner may provide flex, stiffness, lift, cushioning, or the like in areas of the heel, arch, metatarsals, and forefoot. The layup typically includes multiple layers of expanded polymer material (plastic or elastomeric foam). These may be cut, overlaid, embossed, debossed, or a combination, in or out of a mold, to locally alter density, thickness, softness, or stiffness.

9 Claims, 15 Drawing Sheets

(56) References Cited

U.S. PATENT DOCUMENTS 4,435,910 A * 3/1984 Marc ..... A43B 21/32 36/173
4,534,121 A * 8/1985 Autry ..... A43B 7/144 36/43
4,619,056 A * 10/1986 Lin ..... A43B 7/142 36/43
4,897,937 A * 2/1990 Misevich ..... A43B 7/1435 36/43
D326,179 S 5/1992 Walker
5,951,935 A 9/1999 Healy et al.
D429,410 S 8/2000 Wright
6,195,918 B1 3/2001 Kelley et al.
6,543,158 B2 4/2003 Dieckhaus
6,976,322 B1 12/2005 Walker
7,325,323 B2 2/2008 Katsu et al.
D595,938 S 7/2009 Fuchs
7,707,742 B2 5/2010 Ellis, III
8,069,586 B2 12/2011 Orvitz
D676,224 S 2/2013 Marshall
8,671,590 B2 3/2014 Rasmussen et al.
D702,430 S 4/2014 Nascimento
D730,035 S 5/2015 Henderson
D748,386 S 2/2016 Henderson et al.
D793,682 S 8/2017 Bacon et al.
9,770,064 B2 9/2017 Kosta
D800,433 S 10/2017 Kuerbis
D802,899 S 11/2017 Bischoff et al.
D807,001 S 1/2018 Greenhalgh
D809,758 S 2/2018 Taestensen et al.
D814,156 S 4/2018 Mial
D821,717 S 7/2018 Howe
D833,721 S 11/2018 Winfield
D845,595 S 4/2019 Swegle et al.
D845,598 S 4/2019 Loveder et al.
D845,600 S 4/2019 Evans
D858,967 S 9/2019 Mial
10,524,538 B2 1/2020 Hurd et al.
10,561,199 B2 2/2020 Hillyer et al.
D876,782 S 3/2020 Fontaine
2003/0150134 A1* 8/2003 Hardt ..... A43B 7/144 36/145
2007/0033834 A1* 2/2007 Cheskin ..... A43B 7/223 36/28
2007/0204484 A1* 9/2007 Davis ..... A43B 7/144 36/97
2013/0305562 A1 11/2013 Thatcher et al.
2015/0223560 A1 8/2015 Wawrousek et al.
2016/0051009 A1 2/2016 Kormann et al.
2016/0227878 A1 8/2016 Lan
2018/0070670 A1* 3/2018 Granger ..... A43B 1/0009
2018/0140040 A1* 5/2018 Granger ..... A43B 7/1435
2018/0192739 A1* 7/2018 Granger ..... A43B 17/14
2019/0029365 A1 1/2019 Lucca
2019/0289962 A1 9/2019 Costa et al.

* cited by examiner

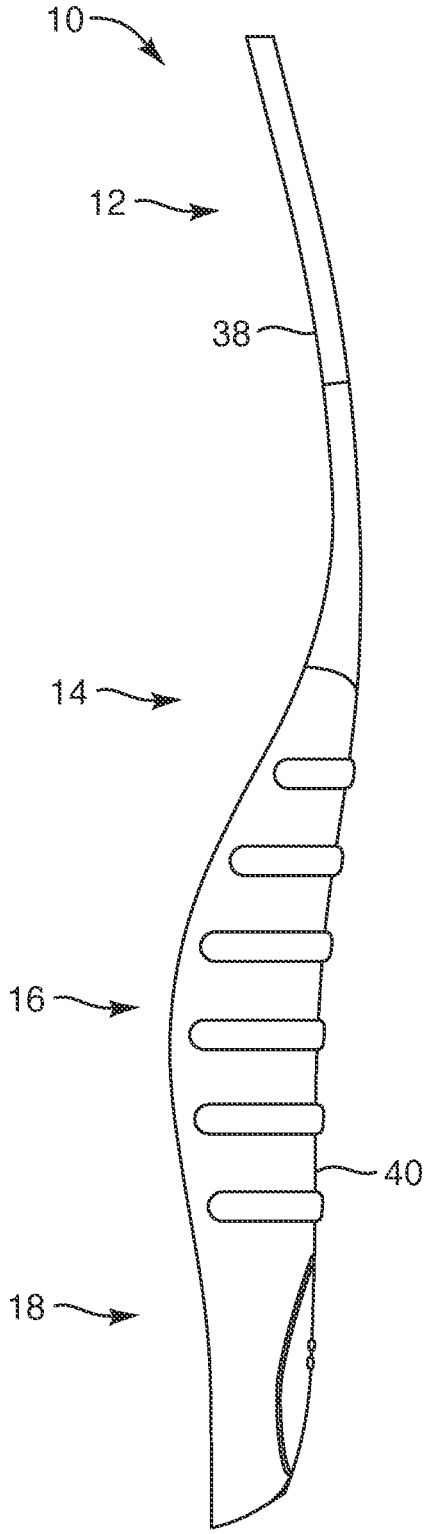
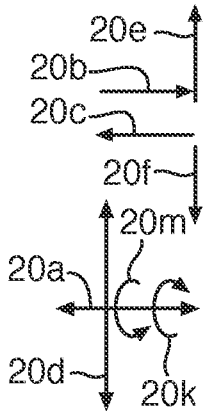
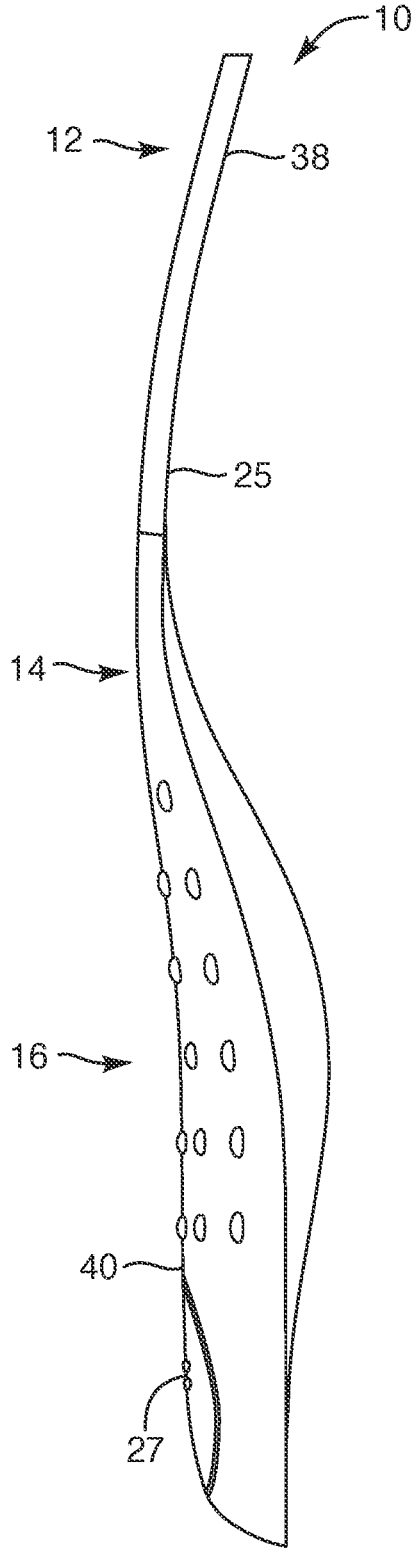
FIG. 5
FIG. 6

Section A-A

Section B-B

Section C-C

Section D-D

Section E-E

Section F-F

Section G-G

NATURAL-CUSHIONING, SOCK LINER APPARATUS AND METHOD

RELATED APPLICATIONS

This Application claims the benefit of U.S. Provisional Patent Application Ser. No. 62/799,552, filed Jan. 31, 2019, entitled ORTHOTIC SOCK LINER, and U.S. Provisional Patent Application Ser. No. 62/841,607, filed May 1, 2019, entitled ORTHOTIC SOCK LINER. All the foregoing and U.S. Pat. No. 8,671,590, issued Mar. 18, 2014, entitled SHOE STABILITY LAYER APPARATUS AND METHOD are hereby incorporated herein by reference.

BACKGROUND

Field of the Invention

This invention relates to footwear and, more particularly, to novel systems and methods for sock liners.

Background Art

Shoes may typically contain an upper that covers the superior (top side) or dorsal aspect of a foot as well as certain portions of the lateral (outside) and medial (inside) aspects thereof. Typically, except for clogs and certain types of sandals, a heel portion including a heel counter will surround the back of the posterior aspect of the heel of a foot. Shoes necessarily, when mass manufactured, tend to have a comparatively flat surface for the insole, directly under a foot and sometimes referred to as an insole board.

What is needed is a method and apparatus for providing a better interface between a shoe and the foot of a user. It would be an advance in the art to provide an improved, comparatively inexpensive, and yet properly supportive and cushioning sock liner as an "orthotic" for placing in shoes.

BRIEF SUMMARY OF THE INVENTION

In view of the foregoing, in accordance with the invention as embodied and broadly described herein, a method and apparatus are disclosed in one embodiment of the present invention as including a sock liner made up of a base portion or layer over an intermediate layer, together shaped to underlie a foot of a user and both shape and support it inside a shoe.

Often the feet of a particular individual will not be strictly conformal to the insole of a shoe. For these and other reasons, shoes may not be comfortable. Shoe inserts may be added. They are sometimes referred to as inserts or inaccurately referred to as insoles. An insole is a structural part of a shoe. An insert is not. A sock liner is configured to fit against a sock and against an insole therebelow.

Conventional shaping of all the foregoing types, will still fail to address another issue on which comfort depends. The foot has a natural mechanism for absorbing shock or pressure between a shoe and the bone structures of the foot. It is called a "fat pad." It extends along the entire underside (inferior aspect) of the foot, varying in thickness by location. Moreover, with age, the fat pad tends to thin out. Meanwhile, in operation, the fat pad tends to "squish" out from under loads, according to the Poisson effect.

Thus, in an apparatus and method in accordance with the invention, a focus is on manipulating the fat pad by containment. If loading pressure is vertical, then containment in a lateral direction provides better cushioning by the fat pad.

This may occur either during manufacture as a liner or as an aftermarket "sock liner" or "insert." Inserts may sometimes be referred to inaccurately by others as insoles. Herein, the word "insole" will always refer to that portion of a shoe used by the manufacturer to establish and maintain the position of the "upper" on a last (shoe pattern, shaped like a foot) or to otherwise represent the interface between the last with and the outsole.

A last is a pattern approximating the shape of an outer surface of a foot, and used inside a shoe upper to shape it during manufacture. A last looks like an upside-down foot. A shoe is built "on" a last, sole at the top during construction, sole at the bottom during use. Lasts are often highly technical devices, shaped with movable parts in order to create a shoe fitted thereto. A last may accurately be referred to as a "pattern" for a shoe. Indeed, it is a three-dimensional model of a foot, more or less, for forming thereon a shoe.

To a base layer of an insert in accordance with the invention, introduced hereinabove, may be added one or more intermediate layers that may typically cover (be coextensive with) less than all of the undersides inferior aspect in use, of the base. In this way, the base may be augmented to add stiffness, support, softness, compliance, thermally conforming material, cushioning materials, pressuring materials, or the like as needed to shape the fat pad under different portions of the bone structures of the foot of a wearer.

A top (superior, in use) layer may provide simply a uniform and attractive, comfortable interface between a sock of a wearer and the shoe. It may provide grip, labeling, design appearance, or the like. Under that top layer may be the base. Under the base may be provided one or more intermediate layers providing additional support but especially shaping to a fat pad of a user. Support may be specialized in its ability to bend, compress, resist, shape, or support vertically, horizontally, or both. It may especially shape support under (in use) the base against the foot typically through the sock on the foot) of a wearer.

In certain embodiments, a base may be "built up," from the point of view of construction on a last (which actually means it is built down with respect to a standing wearer).

For example, a base layer in use will typically lie directly under a top (dressing) layer meant to interface directly with a stocking or sock on a foot of a wearer, or even a bare foot. The top layer usually provides a certain amount of ventilation, grip and limited slip, between a sock and a shoe. It may also present any visible design, ornamental appearance, labeling, color, and so forth by a manufacturer.

Beneath that top dressing layer is bonded the base. Underlying the base (in use) may be one or more intermediate layers between the base layer and, ultimately, the insole of the shoe. In some embodiments, it is conceivable that a manufacturer could create the sock liner in accordance with the invention in such a manner that it could include an insole board and serve as an insole during manufacturer of a shoe. That may not be best for several reasons, and is not the default herein.

Nevertheless, one may assume that the sock liner may be either manufactured and applied to an insole, simply rendered removable by a manufacturer, or sold as an aftermarket insert received within a shoe by insertion against a conventional insole. Meanwhile, a sock liner in accordance with the invention may also be an aftermarket appliance completely independent from a shoe for use in any conventional shoe of a user.

In certain embodiments, the forefoot region of the insert will typically be thinner than an area under the arch. The base layer may have a particular thickness, which thickness may be modified in its mechanical properties by embossing (raising, swelling) debossing (indenting, shrinking) along certain curves corresponding to the curve of force (load path) application resulting from the gait of a user.

For example, a gait of a user often may be described as beginning with a heel strike at which point a heel of a shoe and the heel of a user contained therein, first strike the ground on a posterior (back, rear), lateral (outside) corner of the heel. Forces applied by this process arise from a supporting surface against the shoe and therefore against the heel of a user.

The user now rocks the foot forward toward pronation (prone meaning moving the body or a member toward a prone position which would be face down, toes down, back up). This is in opposition to supination which is any movement that moves (rotates) the body or a member of the body posteriorly toward a back, resting, position with face up, toes up, and back down.

In engineering and technician parlance, a load path is the path that force takes between the originating load (e.g., force, weight, stress, pressure) and its support or resistance location. Load path herein can also, and typically will, mean the curve along which that technical load path (near the ground) progresses along the liner during a gait cycle (a stride, two steps). We may use the term either way, but the context will make it clear. When the word "curve" is added, or used instead of path, the latter definition applies.

Following a heel strike, as the foot pronates, the load path of force, from body to shoe to ground, rocks forward on the foot defining a load curve along the insole as the sole of the shoe rests fully on the ground, at a midstride position. In this position, the force curve (load path curve) has moved from the outer corner of the heel toward a position along and under the arch, and toward the metatarsal region. As the user now moves forward, the leg above the foot begins to bend the foot, the toes being pressed against the supporting surface.

The metatarsal bones (metatarsals) and the heel begin to rise (pronate, rise at a posterior end) and rock over the ball of the foot. The ball is the joint between the metatarsals and the proximal bones of the phalanges (toes). Ultimately, to move forward, the wearer must push off with the toes thus sweeping (pronating) the toes in relative motion back as the metatarsals and the heel move forward. The foot is picked up to lift and swing (supining). The foot moves forward and ultimately repeats the heel strike, midstride position, and toe off or push off motions.

Certain embodiments of inserts in accordance with the invention may include intermediate layers (between a base and an insole). Such layers may bond to the base layer, extending only partially therealong or thereacross. Alternatively layers may be consolidated by molding a single layer onto the base. For example, an intermediate layer may add localized thickness, density, stiffness, or any combination thereof, near or along the medial (inside, toward a center plane, as these terms are used in medical parlance) side of the arch region.

They then extend as separated fingers or protrusions toward the lateral (outside) side of the base. Toward the lateral side of the arch, for example, the bone structure is usually lower and maintains the contact with the insole. It therefore needs the fat pad to be shaped and constrained to support it. The insert or sock liner is typically made stiffer by being more dense on the medial side. It contains (laterally urges or restrains) the fat pad and urges it to remain under the load path curve. Any density, stiffness, thickness located medially, or bulk therefrom is not designed so much for supporting the arch but for fat pad containment and shaping.

Thus, the intermediate layer may actually extend laterally, being thinner nearest a load curve to encourage the fat pad to focus there. A midline or middle axis is not strictly an axis or "axis of symmetry," because it may be a line or curve running longitudinally, depending on purpose. For example, it may run toe tip-to-heel on the foot. It may pass through a centroid of area, width, or the like. It may be strictly front (fore) to back (aft) in direction of travel, or instead along the foot elsewhere. The force curve or load path curve, meanwhile, runs from near the center of the heel out under the arch to the ball. The toe portion of the foot is used to push off.

One may refer to a line along the center of mass moving along the foot from posterior to anterior (rear to front) as an axis. The load curve is curved. At any point along that axis or that load curve, one may move medially or laterally (both of which directions would be considered transverse directions with respect to a longitudinal direction fore and aft (anterior and posterior).

In certain embodiments, the intermediate layer may actually reduce to individual fingers (projections) of material that extend laterally farther toward the foot axis or beyond from the medial side of the base. In other embodiments, other shapes may be made that represent quasi-trapezoidal shapes that extend from a comparatively smaller radius at the medial side of a foot, typically under the arch, toward a larger radius moving toward the lateral side of a foot.

For example, in certain circumstances, one may think of a footprint in the sand or a footprint of a wet foot on a paper towel or other surface that will absorb or otherwise show water. One will see that the individual toes each make an imprint representing contact with the supporting surface. Likewise, the remainder of the forefoot region, from the ball on the medial side to the outermost edge of the forefoot. Meanwhile, a rather narrow longitudinal band extends along the lateral side of the midfoot back toward the heel. The heel represents another comparatively large area of contact extending transversely across the entire foot.

A sock liner in accordance with the invention is not primarily an arch support. The arch of a shoe and the liner do both provide an initial shape. A sock liner in accordance with the invention augments the shape of the shoe to shape fat-pad, cushioning, support the lateral aspect of the heel, arch, metatarsal, and ball regions of a foot of a user. The sock liner's principal function is to urge the fat pad into a contained shape cushioning the various portions of the foot. In other words, the sock liner's principal function, within these specific embodiments, is to urge the fat pad into a contained shape under the bone structures of the foot in order to cushion the foot during the loading (pressure) along the entire loading curve, as described above.

It is often not appreciated that the metatarsal region, is itself concave along a medial-lateral (side-to-side) line across its inferior or plantar aspect (the bottom of the foot). Thus, in an apparatus and method in accordance with the invention, various numbers and shapes of intermediate layers may be provided in order to build up a sufficient thickness, stiffness, softness to urge conformal shaping of the fat pad in each region of the foot. Flexibility and density may provide appropriate comfort in bending with the gait of a user. To that end, various tools may be implemented in accordance with the invention to provide the sock liner with specific mechanical responses to the foot and the shoe, between which two the sock liner resides.

For example, fingers of an intermediate layer may begin projecting out (laterally) across and under the base in order to provide acupressure, intentionally localized pressure. This may be done by increasing medial density and thereby increasing the localized "spring constant" for compression of the liner. The fat pad is conformed laterally away from stiffer and denser support toward softer, less dense, more compliant lateral regions. Softer, more compliant areas of the sock liner (liner, insert) may provide a reduction of pressure and space for building up (shipping, receiving) the fat pad. Increasing and raising a contact area against the foot urges the fat pad away therefrom.

Meanwhile, these fingers or projections may be partially debossed to render them locally more dense. Locally, this may make them more bendable (reduced section modulus) across the deboss. At the same time, portions are stiffened against vertical compression due to increased density. A center portion of a projection finger may actually be embossed (extended away at reduced density) in order to render it softer and thicker. This may be done while densifying (e.g., heating and compressing) other portions, such as edges.

Similarly, in a quasi-trapezoidal type of intermediate layer, or projections of an intermediate layer, may be calculated gaps or breaks. Also, medial-lateral debosses may form. Separations between longitudinally adjacent trapezoids, may provide for reduced section modulus in order to enable easier bending of a longitudinal "beam." These may also provide breaks to adjust compressive density for vertical stiffness at various locations. Vertical means both superior movement and inferior movement or up-and-down movement.

These gaps between adjacent fingers, protrusions, or extensions of the intermediate layer across from medial to lateral direction of the base may be engineered to provide a balance of stiffness to urge the fat pad at any location to remain under the load path curve.

In certain embodiments, multiple intermediate layers may be bonded to a base. Bonding may be done by molding where thermoplastic layers are heated in order to shape them and bond them to one another. Similarly, cement may be used with certain embodiments in order to bond layers of certain polymers to one another. As a practical matter, it has been found effective to use expanded polymers (plastic foams, elastomeric foams, rubber foams, and so forth) that are thermoplastic in nature.

Thermoplastic means that a material responds to increased temperature by softening or even melting. A thermoplastic is characterized in that if it is reheated, it re-softens or re-melts. In contrast, thermosets may undergo exothermic or endothermic reactions. Regardless, a thermoset material is a polymer that may cure with temperature, react with temperature, respond chemically to temperature, or itself raise temperatures in the process of curing between its state as a resin (often a liquid phase) and the thermoset (in a reacted, solid phase).

However, thermosets are characterized in that they will not further respond significantly to temperature. If they are reheated, they do not melt, and their reactions are not reversed. In many instances, such as with epoxies, one may heat a thermoset to incineration temperatures, and it will still maintain its shape as it reduces to pure carbon.

Thus, certain intermediate layers may be added to a base in order to cover a portion of a heel, and extend forward to the arch, as well as under the metatarsal region, thereby containing and urging the fat pad to thicken and remain under the areas of greatest stress (pressure) under the bone structures of the foot. An additional extension or an intermediate layer may be added. An insert may "wrap" around as a semicircular cross-section to provide containment side-to-side.

In certain embodiments, all layers (base, intermediate, etc.) may be bonded together by glue, solvent, or other permanent mechanism. On the other hand, bonding need not be permanent. Hook- and loop fasteners may be used to interconnect two layers. Temporary adhesives, mechanical locking mechanisms, post-in-hole connectors, or a host of other connection schemes may operate between two layers to keep them together and resist misalignment.

Similarly, multiple layers may have different lengths of lateral extension for the projections that may be formed therein. Various layers may have greater or lesser density and greater or lesser spring constants (deflection per unit of force, or vice versa).

Nevertheless, a foot will typically be more comfortable if the softer material and the comparatively lower density material can be positioned closer to the foot, while the stiffer and comparatively more dense material is positioned closer to the shoe. Thus a base layer, an intermediate layer, or multiple intermediate layers may be configured and constructed accordingly.

Sock liners in accordance with the invention may be customized by the densities chosen for each layer, and the related comparative stiffness. In certain expanded polymers density and stiffness (spring constant) correlate to a greater or lesser extent. Different polymers may be chosen for different layers to uncouple these properties.

A specific sock liner may be customized with each of the parameters affecting shape, stiffness, density, and so forth. Thus, whether co-molded or assembled after manufacturing, each layer may be selected by its thickness, density, stiffness, shape, lateral projections, gaps between lateral projections, shape of fat-pad containment projections in any direction, or the like.

In certain embodiments of sock liners in accordance with the invention, the term "longitudinal" refers to the "fore and aft" or "anterior and posterior" extent of a foot and of a sock liner generally. Passing in either direction, it is not necessarily centered, and need not be strictly a straight line.

By appropriately debossing, the foot liner may have curves that mimic, follow, or proceed somewhat congruent to the "load curve" or "pressure curve" as the center of pressure on a foot and sock liner proceeds through the gait of a wearer. Debossing along such curves may provide for densification for vertical stiffness, and also easing longitudinal bending for the foot, while still providing vertical stiffness by increased material density and an almost independent alteration of section modulus.

Section modulus is a property of a shape of a material. It represents to some extent a cross section in beam bending. Beam bending is well defined in engineering arts. Even with or without the understanding of an engineer, a technician or one of ordinary skill in the art will understand beam bending. One may support an elongated rigid member at each end, and apply a force somewhere between those two ends. The article will bend. That is beam bending.

Necessarily, in beam bending, the uppermost fiber (that is the uppermost face, surface, or edge of that beam) will be in compression directly under the load. Meanwhile, the outermost fiber or the bottom-most surface of that same beam under the load will necessarily be in tension.

Thus, through the cross section of that beam, the forces longitudinally extending along that beam in response to a transverse load perpendicular to the longitudinal direction must necessarily pass from compression to tension. The plane at which the forces of longitudinal stresses in that beam change from compressive to tensile (tension) represents a neutral axis. It is a plane of zero stress. Thus, one may see that a sock liner under the foot of a user, which foot flexes in multiple dimensions, undergoes beam bending (posterior to anterior and medial to lateral).

On the one hand, vertical support under an arch may be necessary, especially to shape the fat pad. Conventionally, support is often referred to as posting. This basically refers to placing some kind of material under the arch of a foot so that the arch is not permitted to descend below where it ought or where it is comfortable. An apparatus in accordance with the invention may provide some posting but that is not the principal point.

That is, ailments such as plantar fasciitis result from inflammation of the fascia along the plantar aspect of a foot. Often this inflammation is exacerbated by excessive stress (force per unit area) or by strain in any direction of multiple directions. Strain is a length of extension per unit length in the direction of force applied to a material or member.

In general, a sock liner in accordance with the invention may provide periodic, specifically located, and often intermediately applied support by stiffness in one area, thereby urging the fat pad into containment and thickening in an adjacent area. This containment force may be along a transverse direction (medial, lateral, or both), or longitudinal (meaning fore or aft, being the same as anterior or posterior) direction. Meanwhile, relying on the Poisson effect (conservation of mass and stability of density), vertical support may be effective to redirect the fat pad to an area where best applied and needed. This may be done with various degrees of density, stiffness, force, pressure, resilience, or softness.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 5 is a medial side elevation view thereof;

FIG. 6 is a lateral side elevation view thereof;

DETAILED DESCRIPTION OF THE PREFERRED EMBODIMENTS

Figure 1:
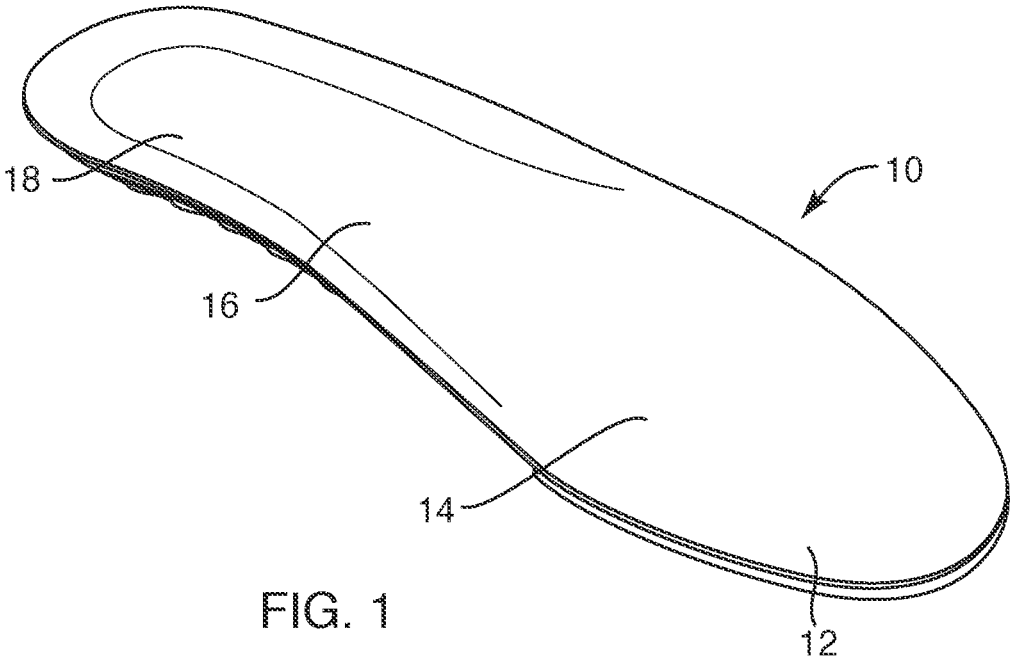
FIG. 1 is an upper perspective view of one embodiment of a sock liner in accordance with the invention, relying on an extra intermediate layer attached to a base layer in order to build up support and comfort in a sock liner for insertion into a shoe.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

A certain amount of curvature from front to back (anterior to posterior, which together constitute a longitudinal direction) may be present under the toes and the ball (joinder of phalanges and metatarsals, toes and connecting bones) of the foot (together constituting a forefoot region), progressing backward (posteriorly) through the metatarsal area and the arch (together constituting a mid-foot region), and finally to the heel. The heel is characterized by the calcaneus bone, the large and singular structure of the foot immediately below the ankle.

In conventional manufacture, an upper of a shoe is formed around a last, with an insole on the last, or an insole board on the last, around which the edges of the upper are wrapped and secured. As the leather or other sheet material of the upper is wrapped around the last and the insole board, it may then be maintained in position by nailing, stitching, cementing, or the like. Typically, one may consider a last position to be an upside-down model of a foot in a manufacturing process. A worker draws the sheet material of the upper upward and around the last and insole.

A midsole may be fastened to capture the upper between it and the insole by stitching, nailing, bonding, cementing, or other mechanism to the insole. This captures the edges or extreme extent of the upper that has been wrapped over the lasting board (insole). Typically, shoes may have a heel added. Some may simply have the heel formed as part of the midsole or outer sole.

Ultimately, an outer sole of a shoe is added as the contact material that touches a sidewalk, street, or the ground. It is the responsibility of the outer sole to actually take the wear from contact with the ground or surfaces walked on. It is the responsibility of the insole in a conventional shoe to contact the foot of a user or typically the stocking or sock worn by a user. Other manufacturing methods exist including the Strobel method, and others that may be known to those skilled in the art of shoe manufacturing.

Ultimately, the shape of the shoe, and particularly the conventional insole, may not match exactly the specific shape of a particular user's foot. Often this is not problematic. In other circumstances this is seriously problematic. Flat foot or "fallen arches" and the like may require additional support such as an arch support (sometimes called posting). Aging wearers may find that the calcaneus bone or other portions of a foot require additional cushioning as the fatty tissue that forms a pillow under the foot from the toes back to the heel may need to be augmented.

Manufacturers may or may not add a basic sock liner of fabric or cushioning material on top of the basic insole. Such may be added by a wearer as an aftermarket product. Such cannot address the myriad issues that may arise in fitting a real shoe to a real foot in practice.

Alternatively, custom orthotics are specifically formed, either by casting, molding, or the like to better fit a shoe to the shape of a foot of a user by serving as a new interface between the shape of a foot and the shape of the insole of a shoe. Regardless, these piecemeal mechanisms for improving the fit, contact surface area, and comfort of shoes are often inadequate.

Custom orthotics are typically extremely expensive. They initially involve consulting with a specialist in the subject. Then, a laboratory is responsible for creation of those custom fitted inserts for shoes of a wearer. Finally, a wearer must try them and find them satisfactory, or start over.

As persons age, the natural fat pad 64 (see FIGS. 12, 28, 29) under the bone structures (see FIGS. 12, 28, 29) of the feet or the tendons may thin, flatten, or deform when loaded (force or pressure is applied). Certain padding for containing and shaping portions of the fat pad 64 on the underside (inferior aspect) of a foot may be very helpful.

Referring to FIGS. 1 through 16, with details best identified in FIGS. 8A through 8C and 14-16, but generally applicable to all FIGS. 1 through 32, a sock liner 10 may extend from a forefoot region 12 representing the front, anterior, or foremost part of a foot (phalanges, toe ball), and back (posteriorly) through a metatarsal region 14 extending back from the ball of the foot toward the heel, then an arch region 16, and finally extending to a heel region 18. One may think of the directions in engineering or medical terms.

For example, a direction 20*a* may represent a transverse direction, which extends in both a medial direction 20*b*, meaning toward a center line or center plane of symmetry of a body, and in a lateral direction 20*c*, meaning away from a center plane of symmetry of a body. The longitudinal direction 20*d* represents both a forward direction 20*e*, which also represents an anterior direction 20*e*, as well as a rearward direction 20*f*, which may be characterized as a backward direction 20*f* or a posterior direction 20*f*.

A vertical direction 20*g* includes both a superior direction 20*h*, meaning upward, and an inferior direction 20*j*, meaning downward with respect to a standing body. Meanwhile, two rotational directions are of interest in trying to describe bodily motions and foot motions. These include a prone direction 20*k* or pronation direction 20*k* meaning rotating ("top forward") toward a body being prone with the anterior aspects downward, face down, toes down, and so forth.

Supination 20*m* or a supine direction 20*m* represents a rotation ("top backward") in opposition to a pronation direction 20*k*. This means any movement by a member tending to move toward its supine position which would be having the posterior aspect of the body downward and anterior aspects of the body upward with toes up, face up, and so forth.

A sock liner 10 includes a base 22 that also may be referred to as a base layer 22. The base layer 22 is not actually positioned closest to the insole of a shoe. Rather, the base 22 represents the approximate shape of the entire foot and the entire insole shape of a shoe. It may vary throughout its area and along any of its directions 20*a*, 20*d*, 20*g* in thickness and material properties.

In the illustrated embodiment, the base 22 may be covered with a contact layer 24. This may be thought of as a top sheet 24, typically of uniform thickness and homogenous material (same throughout). It will actually contact, ultimately, the sock or foot of a user wearing a shoe provided with a sock liner 10 in accordance with the invention.

Within the sock liner 10 may be included an intermediate layer 26 (intermediate the base 32 and the insole) that underlies a selected portion of the base layer 22 in use. This intermediate layer 26 is engineered to provide intermittent (in space) variations in density, stiffness, support, thickness, thinness, bending, and so forth under the foot of a user. To this end, the intermediate layer 26 may be embossed (raised above a surrounding area) within certain boundaries 30 defining the intermediate layer 26 with respect to the base layer 22.

Likewise, debossing regions 32 may exist, where debossing 32 is a surface (or making one) down below the nominal surface of a material by compression, molding, melting, heating, cutting, or the like. Thus, in embossed regions 28 or long embossed portions 28, the intermediate layer 26 is formed to be greater than the surrounding nominal surface into a "boss." Thus, debossing work 32 or debossing regions 32 form debossed curves 36.

It may be well to define certain useful terms. Section modulus is a term of art defined in any book on the strength of materials for structures. It represents a formula that may be used to calculate it as a characterization of relative stiffness. It is based on the material properties of a material and the integration of the shape of the cross section with distance from a neutral axis of those materials in beam bending. It is typically proportional to depth (direction of crossing force) to a third power and to breadth, in a transverse direction across the neutral axis of a beam, to a first power.

For example, take the longitudinal direction of a beam extending horizontally, and a transverse direction, perpendicular but still horizontal. Apply a force downward in a vertical direction perpendicular to the transverse and longitudinal axes of that beam. The "base" direction is across the beam perpendicular to a plane defined by the longitudinal and vertical directions. Depth is vertical, perpendicular to a horizontal plane defined by the longitudinal and transverse directions. Meanwhile, the force, parallel to depth, is perpendicular to both the longitudinal and transverse directions. The neutral axis is a horizontal plane extending in all horizontal directions, defining the exact depth location of zero bending stress. The upper, outermost fiber is the top of the beam in compression. The lower, outermost fiber is at the bottom of the beam, in tension.

The section modulus of the cross section of a beam is an integration formula. It reflects not only the amount (area) of material but the position (distance) of that material from the neutral axis of that beam integrated over depth. Thus, in general, section modulus is typically proportional to the third power of depth or vertical distance from the neutral axis as that term has already been defined herein. Likewise, it is proportional to the first power of the width (transverse) of that beam measured perpendicular to the plane of the force and the longitudinal axis.

A boss is a raised area on a surface of a material. A boss has many definitions in the industrial arts. It is generally defined as a raised portion. In some definitions the portion is raised to surround and provide extra thickness around a penetration in an expanse of thinner material. In other circumstances it is simply a raised portion where a web of material is thickened in order to mount something thereto or register thereto. In general, the definition of a boss herein is a portion of a material that extends outward or away from a surrounding surface of which it is a continuous part. Therefore, embossing represents raising such a portion or creating such a raised boss.

Debossing is the opposite of embossing. Rather than adding a boss by embossing, one may deboss by compressing, molding, cutting, or otherwise descending below or descending into surrounding material to provide a line, curve, or portion that is suppressed or descended into a surrounding surface to be below or within it.

Figure 7:
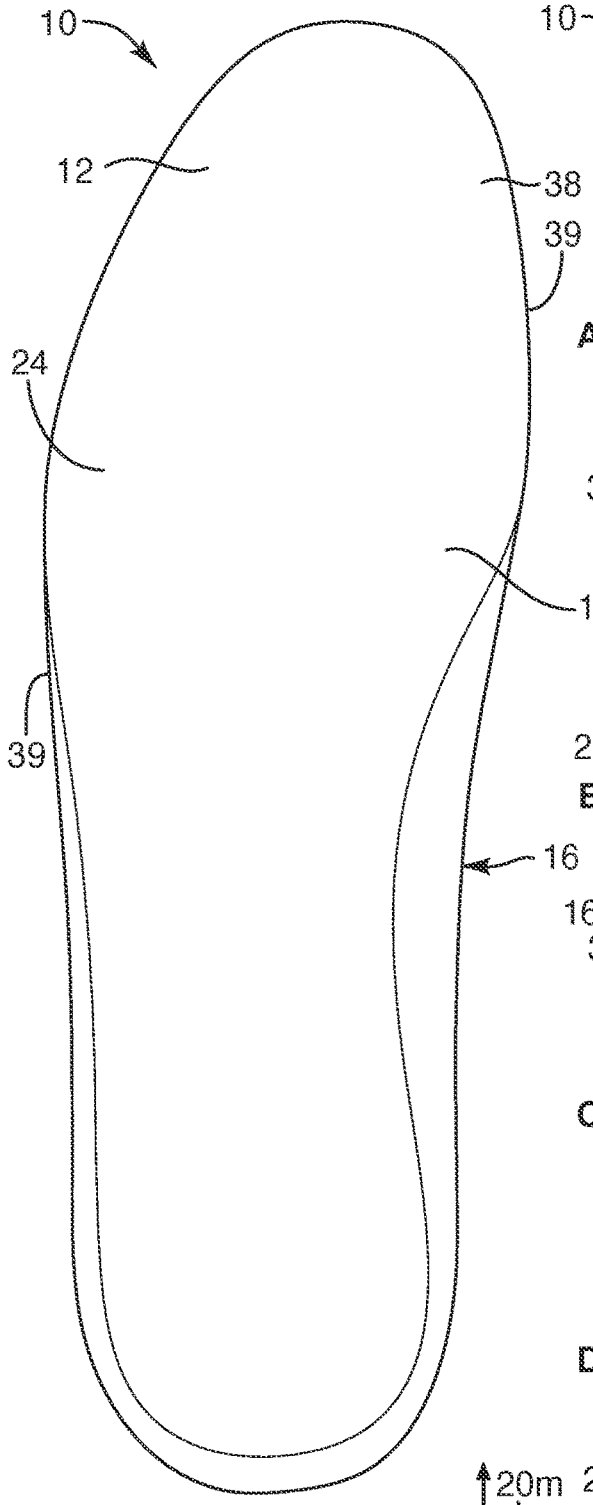
FIG. 7 is a top (superior aspect) plan view thereof.
Figure 8A:
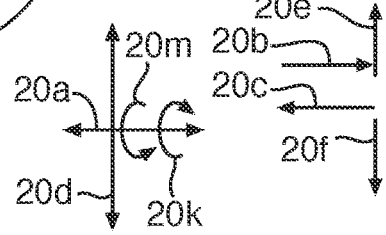
FIG. 8A is a bottom (inferior aspect) plan view thereof.
Figure 8A:
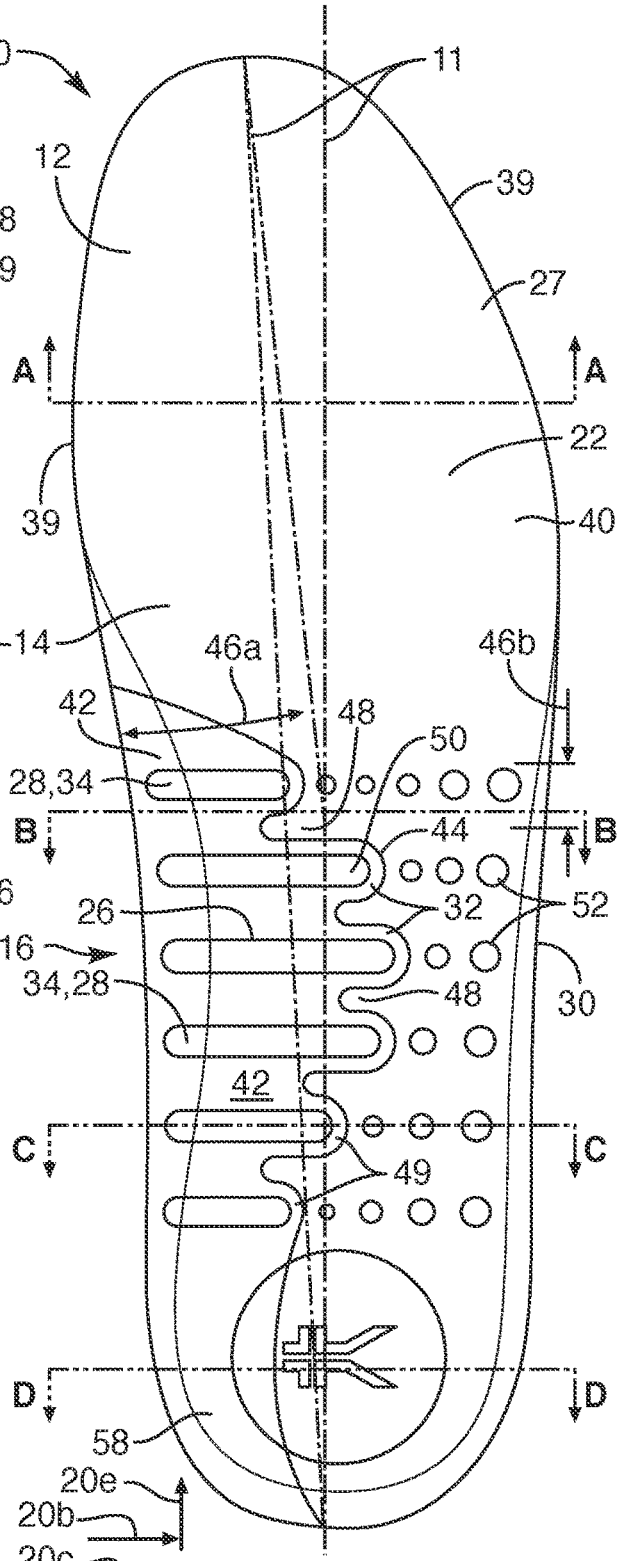

Referring to FIG. 1, while continuing to refer to FIG. 8A and generally to FIGS. 1 through 32, a sock liner 10 includes a forefoot region 12, metatarsal region 14, arch region 16, and a heel region 18. These progress longitudinally 20*d* in a rearward 20*f* or posterior 20*f* direction. In this view, one cannot see the base 22 but only the contact layer 24, which acts as a top sheet 140 above the base 22 when the sock liner 10 resides within a shoe. There is no need to show a shoe here as the patent incorporated hereinabove by reference describes at some length the structure of a shoe and the force curve or path of maximum force occurring (wandering) along the longitudinal direction 20*d* of a shoe during the gait of a wearer.

Gait is the process of stepping. One stride is two consecutive steps. Gait is the process from any starting position through one complete cycle back to that same starting position. Since each foot lifts from the ground within each stride, one may also refer to a gait cycle of interest as a single step from "heel strike," on the ground, to "toe off" when the same foot leaves the ground.

Figure 2:
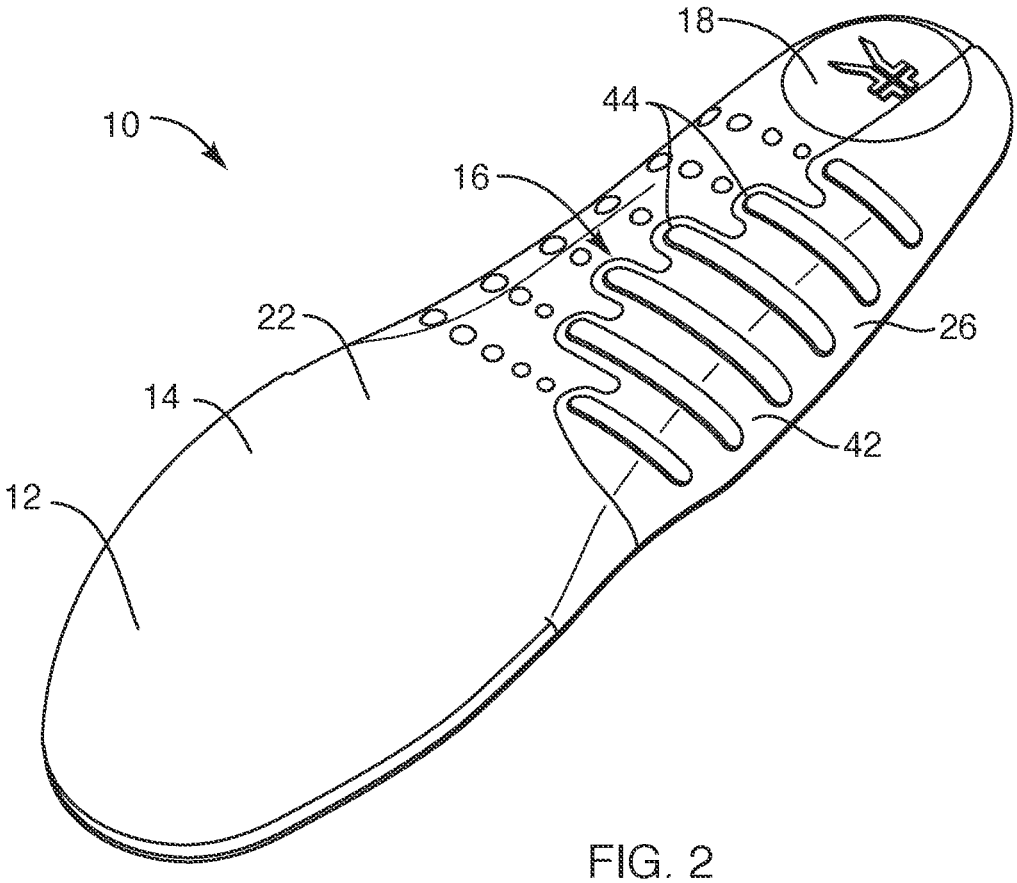
FIG. 2 is a lower perspective view thereof.

Referring to FIG. 2 and FIG. 8A, one can see in this view the base 22 with its contact layer 24 and upper surface 38 extending along the entire base 22, coincident at a periphery 39 or edge 39. An additional intermediate layer 26 may be seen.

In FIG. 2, an intermediate layer 26 adheres to the base 22 by a suitable method as such as heat bonding, pressure adhesion, cementing, or the like. In one currently contemplated embodiment, each of the base layer 22 and the intermediate layer 26 is fabricated of an expanded thermoplastic polymer. Thus, either a closed cell or open cell foam polymer forms a base 22, and the same or another similar expanded polymer may form the intermediate layer 26.

One will immediately notice in FIG. 8A and elsewhere that the intermediate layer 26 in this embodiment is not coincident with the total extent of the base 22 in either the longitudinal direction 20*d* nor the transverse direction 20*a*. In the vertical direction 20*g*, the intermediate layer 26 is additive to the base 22. To the extent that they are bonded together, or placed in a heated mold together, they may be bonded by mechanical interlocking, heat, or cement. The mold may be responsible for enforcing embossing regions 28, debossing regions 32, resulting bosses 34 extending above surrounding lower surfaces 40 of the sock liner 10.

One will see the bosses 34 and debossed curves 36 formed to extend above and below the nominal position of the lower surface 40. Strictly speaking, the bosses 34 and debosses 36 both constitute the continuous lower surface 40. However, if one were to define a nominal surface, such as an average or mean, or a majority of the lower surface 40, the bosses 34 extend transversely away therefrom, while the debosses 36 or debossed curves 36 extend transversely thereinto. In use is the orientation from which all directions will be taken, since manufacturing process may orient an insert 10 in any direction.

For clarity directional terms are superior (up or above) and inferior (down or below) vertically, laterally (outward from center plane) and medially (inward) sideways, and anterior (forward) or posterior (backward) longitudinally. One will note that the boundary 30 of the intermediate material 26 extends laterally from the medial side of the sock liner 10. Moreover, the intermediate layer 26 is formed to include a bulk region 42 that constitutes a continuous expanse 42 of the intermediate material 26. However, at various points in the lateral extent of the boundary 30, projections 44 or fingers 44 extend from the bulk region 42 individually in a lateral direction 20*c*.

The bulk region 42 with its projections 44 of the entire intermediate layer 26 may be removable, rather than bonded to the base layer 22. This approach may include a securement mechanism to secure the removable portion to the base layer 26. In this way, custom fitting may occur onsite at a retail location or at home.

For example, selection of intermediate layers 26 may be provided to a user to be tried for a best comfort selection.

The intermediate layer 26 may be provided in various options with differing maximum thicknesses tapering towards the lateral direction.

On each of these projections 44, a portion may be embossed 28 and other portions may be debossed or treated otherwise. The individual lengths 46*a*, extending transversely (which is laterally), as well as the widths 46*b* which actually extends in a longitudinal direction 20*d*, may be engineered in conjunction with the spaces 48 between adjacent projections 44. In this embodiment, the intermediate layer 26 is bonded to the base layer 22, with the lower surface 40 slightly debossed near the outermost extremes 49 of the projections 44, while the central portions 50 are embossed 28.

The process of compression, which is one mechanism for debossing 32, tends to increase density, collapse air cells (whether open or closed), and generally reduce the section modulus of the sock liner 10. However, the actual material density and therefore strength or maximum stress therealong may be increased by virtue of the increased density and closer proximity of the polymeric materials 22, 26.

Of particular note is a difference between the base 22, with its comparatively sparse and circular pedestals 52 debossed into the base layer 22, and the surface area and extent of the projections 44 or fingers 44 of the intermediate layer 26. Note particularly the extent of the embossed central portions 50 thereof. The spaces 48 between and the widths 46 of the projections 44 (in approximately a base longitudinal direction) and their central portions 50 may be engineered to provide acupressure to regions of the foot in order to principally contain and shape the fat pad 64 in the region while also acting to relieve, support, massage, and otherwise provide a more comfortable interface of the contact layer 24 with the foot of a user (wearer).

In this regard, one may note that the extent of the intermediate layer 26 may be thought of as an augmentation and shaping mechanism to raise the contact layer 24 riding on the insole to a higher density position and thus a spring force more supportive to urge shaping and moving of the fat pad 64. The result is better support of bones, muscles, tendons and ligaments by the fat pad 64, such support and stability being much more comfortable for the wearer. To that end, one may be instructed by FIGS. 3 through 9B.

Figure 3:
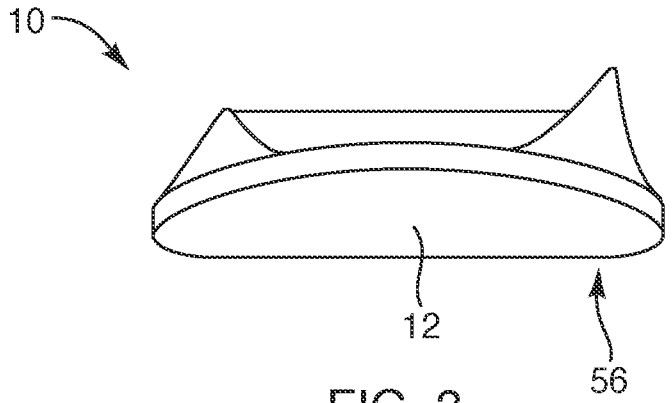
FIG. 3 is a front end elevation view thereof.
Figure 4:
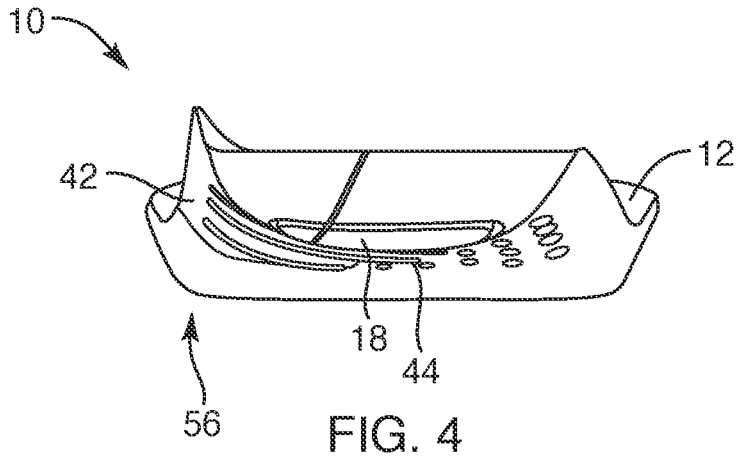
FIG. 4 is a rear end elevation view thereof.

Referring to FIGS. 3, 4 and 8A, the front elevation view again loses some of its ability to convey in every respect the specific shape. Nevertheless, one will immediately notice that the medial side 54 of the sock liner 10 extends considerably higher in a vertical direction 20*g* then does the lateral side 56. This occurs for at least two reasons. In the first instance, the contact layer 24 on top of the base 22 is positioned to cradle the arch of a foot. Thus, it must rise considerably to do so effectively. It extends not only across a portion of the insole of a shoe, but also against a portion of the upper. Meanwhile, the lateral side 56 is considerably lower. It effectively transitions from a stiffer and higher medial region urging the fat pad 64 down to a softer, less dense region laterally where the lateral aspect of the foot receives soft and flexible support from the fat pad 64 contained thereunder. The arch at that longitudinal location is shaped on its medial aspect to contact a higher and more dense supporting surface directly.

Referring to FIGS. 5, 6 and 8A, one may see that the lateral 56 and medial 54 sides of the sock liner 10 exhibit a profile that rises near the toe portion, passes under the ball of the foot, rises in the arch region 16, and continues to rise in the heel region 18. Nevertheless, the periphery 39 extends upward and outward in the arch area 16 and descends somewhat near the heel area 18.

Referring to FIG. 7 and FIG. 8A, one sees in top plan view the dorsal aspect of the sock liner 10. The extremities thereof reach upward near the medial side of the arch region 16 and about and the rearmost (posterior) portion. This latter will eventually pass about the heel counter of the shoe. The sock liner 10 does not just provide a thickness but also an increased density and thus higher spring constant urging shaping and conformity of the various regions of the fat pad 64 under bones 62 (see FIGS. 12, 28, 29) and other tissue of the foot within the shoe.

Referring to FIG. 8A, as well as 8B and 8C, the dorsal (superior) aspect illustrated in the bottom plan view exhibits in detail and proportionality the foregoing descriptions. Again, the base layer 22 has an intermediate layer 26 bonded thereto and suitably embossed about the boundaries 30 of the intermediate material 26 to provide softer areas more easily compressed per unit distance but resulting in equivalent net force and pressure when co-planar with the more-dense surroundings. In this particular instance, the debossed region 36 is here also a branding or marking functionality. However debossing reduces section modulus (easier bending) normal to its tangent.

Figure 9A:
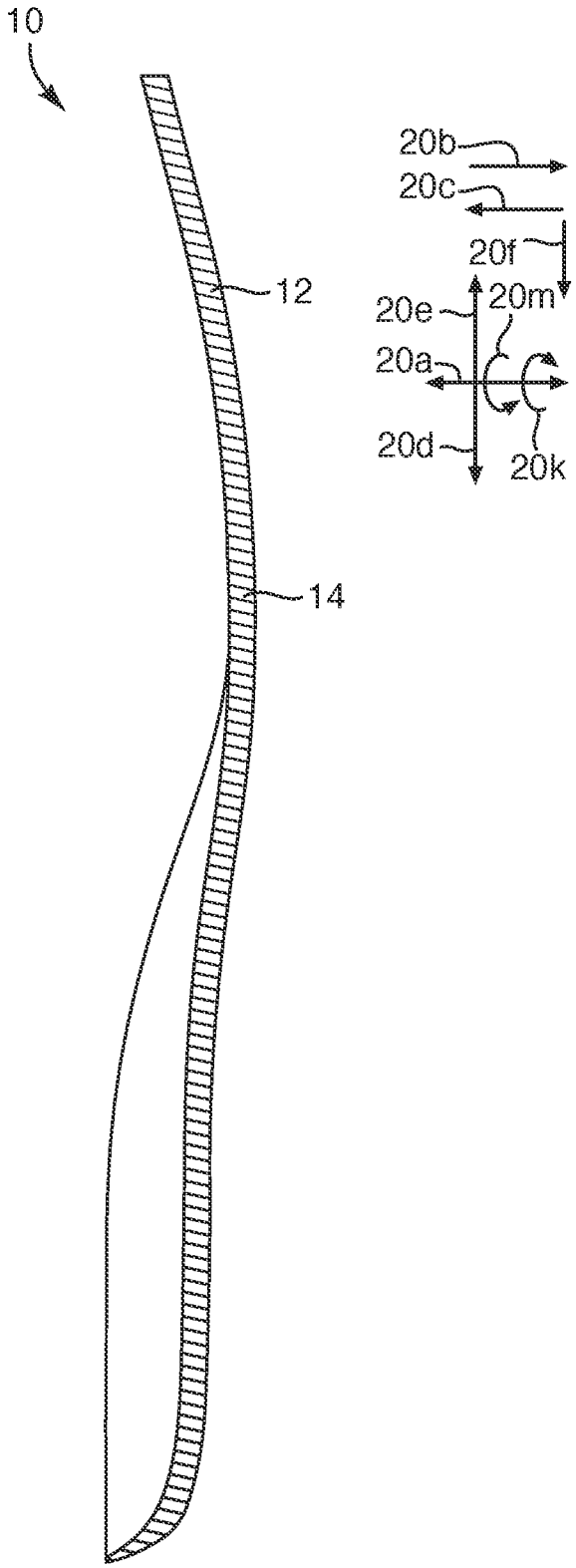
FIG. 9A is a medial (right) side elevation, cross-sectional view thereof along a line down the center longitudinally of the sock liner.
Figure 9B:
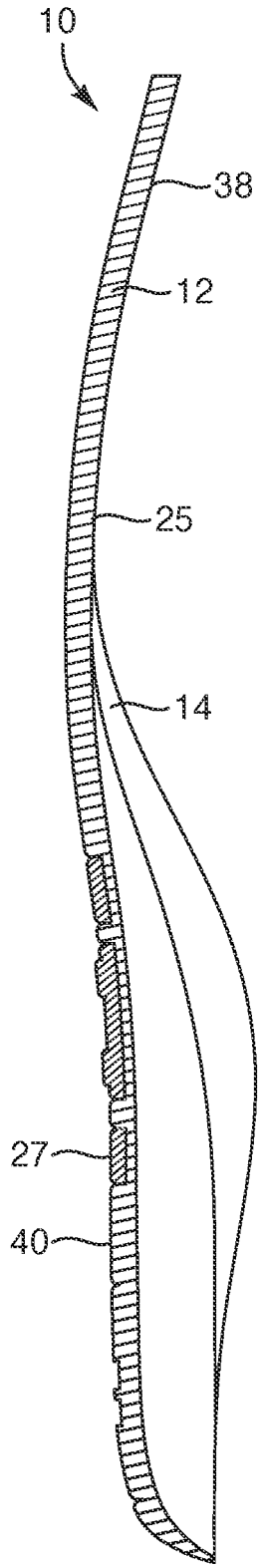
FIG. 9B is a lateral (left) side elevation, cross-sectional view thereof.

Referring to FIGS. 9A and 9B, a cross-sectional view taken along a longitudinal axis 11 through the sock liner 10 illustrates that near the more central portion of the sock liner 10 lies considerably less thickness of material. Near the extremities laterally and medially, a substantial rise and increased thickness may exist. This quasi-semicircular result provides containment and side support for the fat pad 64.

Figure 10:
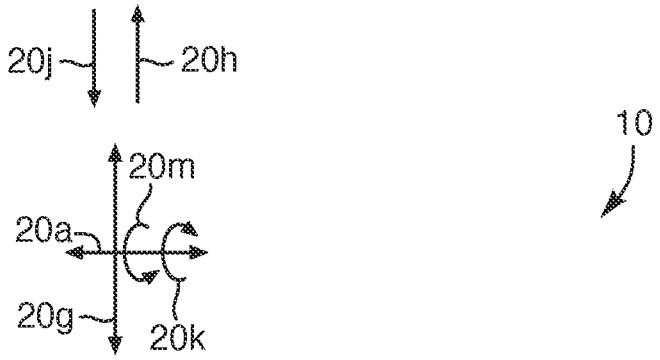
FIG. 10 is an end, elevation, cross-sectional view taken at section A-A line thereof.
Figure 10:
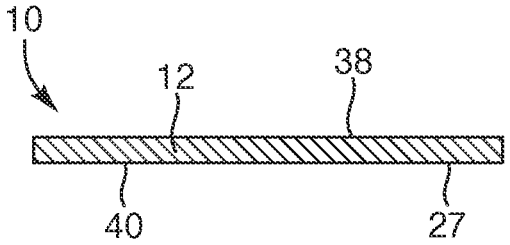

Referring to FIG. 10, a cross-sectional view taken at A-A of the forefoot portion 12 of the sock liner 10 is illustrated and provides from less to almost no augmentation. Besides cushioning under the forefoot of a wearer, increased density posterior to the ball may longitudinally contain the fat pad 64 thereunder. In FIGS. 10-13, the upper surface 38 is positioned to contact the foot or sock of the user, while the lower surfaces 27, 40 contact the insole of a shoe into which the sock liner 10 is installed.

Figure 11:
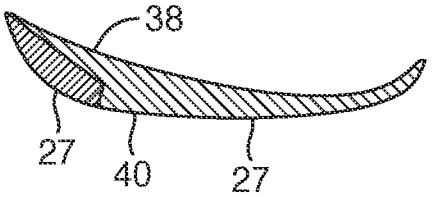
FIG. 11 is an end, elevation, cross-sectional view thereof taken at section B-B.

In FIG. 11, taken at B-B, posterior to the ball of the foot, where metatarsals extend, a concave arch extends upward across a medial-lateral line. One sees that just in the transition portion between the posterior aspect of the metatarsal area, substantial additional density and thickness is added under the medial aspect of arch region 16 urging the fat pad 64 and containment under the lateral aspect of the foot.

Figure 12:
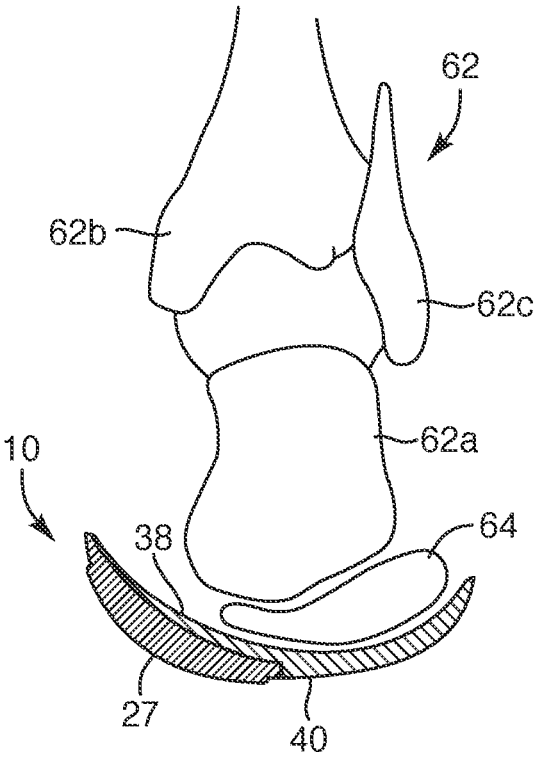
FIG. 12 is an end, elevation, cross-sectional view thereof taken at section C-C, shown in relation to the foot bones bearing thereon.

Referring to FIG. 12, this region begins to extend upward in a section taken at C-C to move the thickness higher under the metatarsal bones to cradle it as one progresses posteriorly along the sock liner 10. The intermediate layer is positioned to contain the fat pad 64 laterally (lateral-ward). The calcaneus bone 62*a* is shown in relation thereto, along with its associated tibia 62*b* and fibula 62*c*, together forming the foot bones 62 bearing thereon. In general various of the constituent bones named hereinabove may be the foot bones 62 bearing on the fat pad 64 in their own specific region of the foot. Nevertheless, the examples shown for the foot bones 62 and fat pad 64 in the illustrated embodiments demonstrate the functioning of the liner 10 generally.

This region extends to move the thickness to a cradle shape as one progresses posteriorly along the sock liner 10. This provides cradling (quasi-semi-circular containment) with the intermediate layer increasing density to contain the fat pad 64 toward laterally (resist from medially).

Figure 13:
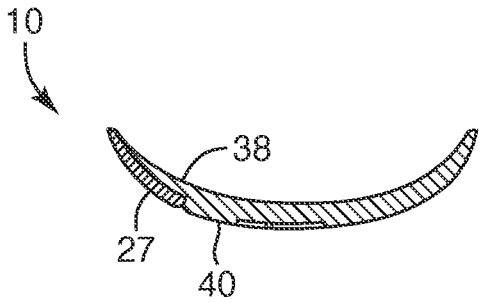
FIG. 13 is an end, elevation, cross-sectional view thereof taken at section D-D.

Referring to FIG. 13, ultimately the heel portion 18 of the sock liner 10, with this section taken at D-D, illustrates that the cushioning and support under the heel portion 18 are much more semi-circular, much more symmetrical, and increase thickness (cushioning) toward the center thereof. The outer edges rise with the medial (aspect at higher density and stiffness (spring constant) due to the intermediate layer 26) to contain soft tissue towards lateral direction under a Poisson effect or "conservation of mass." They eventually fade or feather against the upper.

Figure 8B:
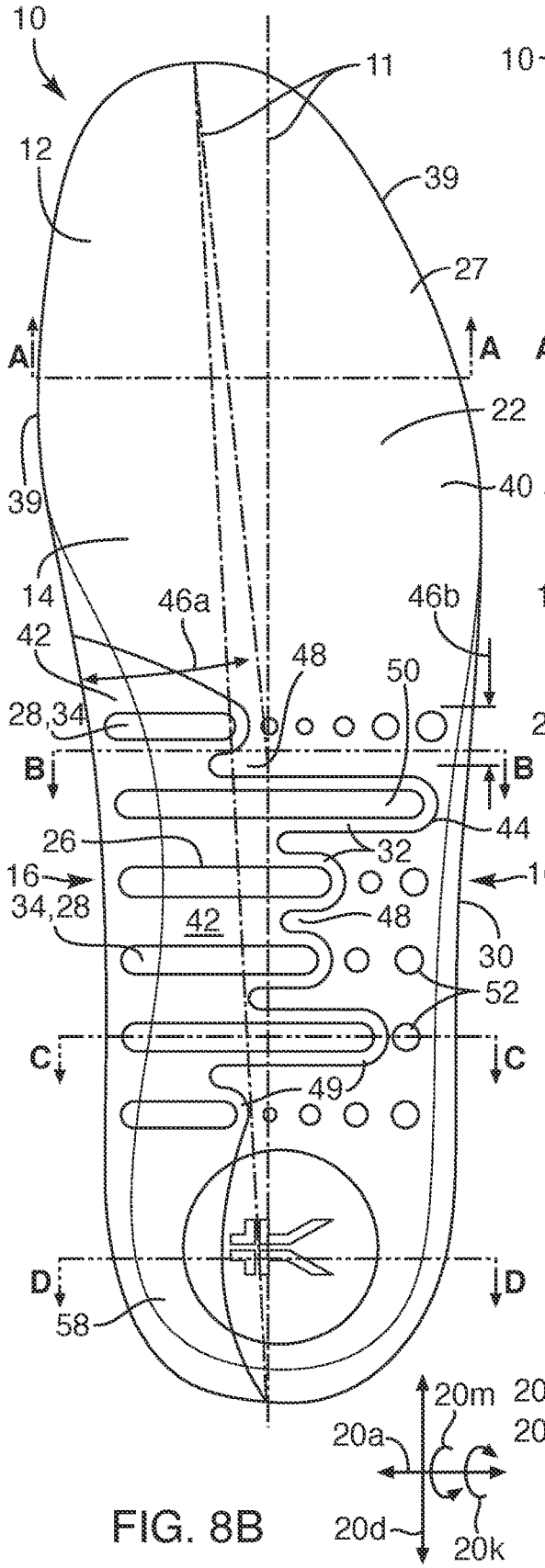
FIGS. 8B and 8C are bottom (inferior aspect) plan views of alternative embodiments thereof.
Figure 8C:
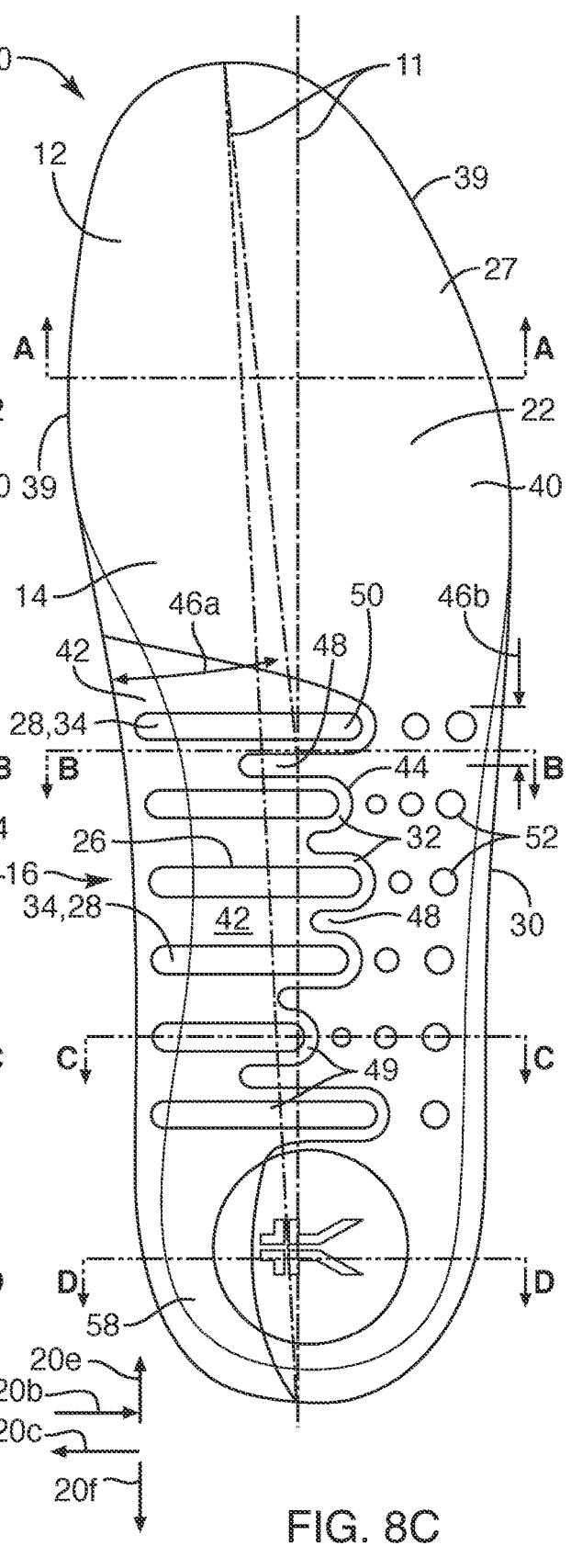
Figure 14:
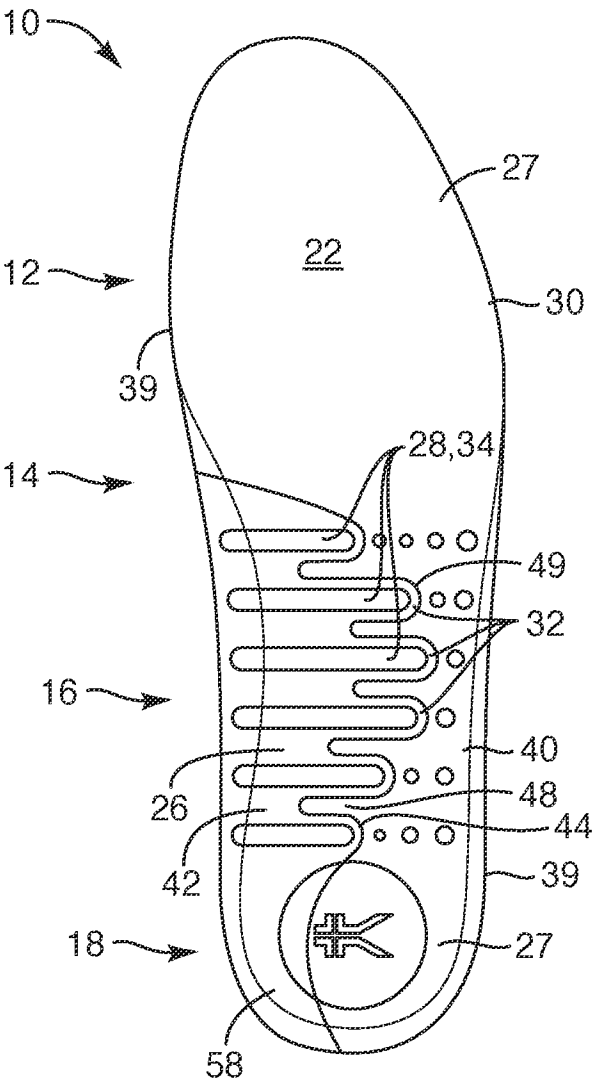
FIG. 14 is a bottom plan view of an alternative embodiment thereof including longer protrusions extending laterally in the intermediate layer.

Referring to FIG. 14, as in FIGS. 8B and 8C, various engineered aspects of the intermediate layer 26 added to the base layer 22 may be configured to provide additional functions and benefits. In this embodiment, the fingers 44 or projections 44 that extend in a lateral direction from the medial side of the sock liner 10 may be comparatively longer than those illustrated in FIGS. 1 through 8A. Accordingly, they may provide greater support or lateral urging over a greater distance, their tapering and spacing being engineered to decay or reduce (feather, graduate) the additional effect for comfort and transition where it becomes less necessary. This will also soften the support and receive additional fat pad 64 mass near its lateral edge. The fingers 44 or projections 44 extend exclusively from the medial side of the sock liner 10, as depicted.

Figure 15:
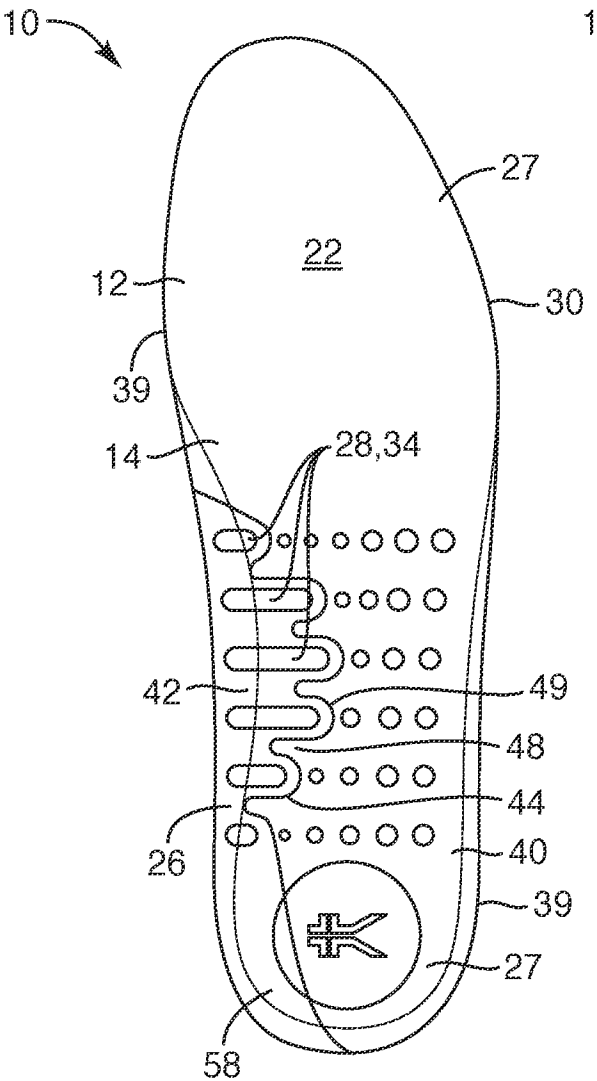
FIG. 15 is a bottom plan view thereof in which the bulk continuous region of the intermediate layer extends less distance laterally.

Referring to FIG. 15, the bulk region 42 or the continuous expanse (unbroken) 42 of the intermediate layer 26 may be reduced in width (longitudinal direction along a liner 10). Thus, a greater portion of the area within the envelope (area or circumference at maximum convex perimeter) defined by the boundary 30 of the intermediate material 26 may be subject to only intermediate support and density increase. Therefore it may provide both support and relief of the associated pressure of the support along the longitudinal direction of the sock liner 10. The fingers 44 or projections 44 extend exclusively from the medial side of the sock liner 10, as depicted.

Figure 16:
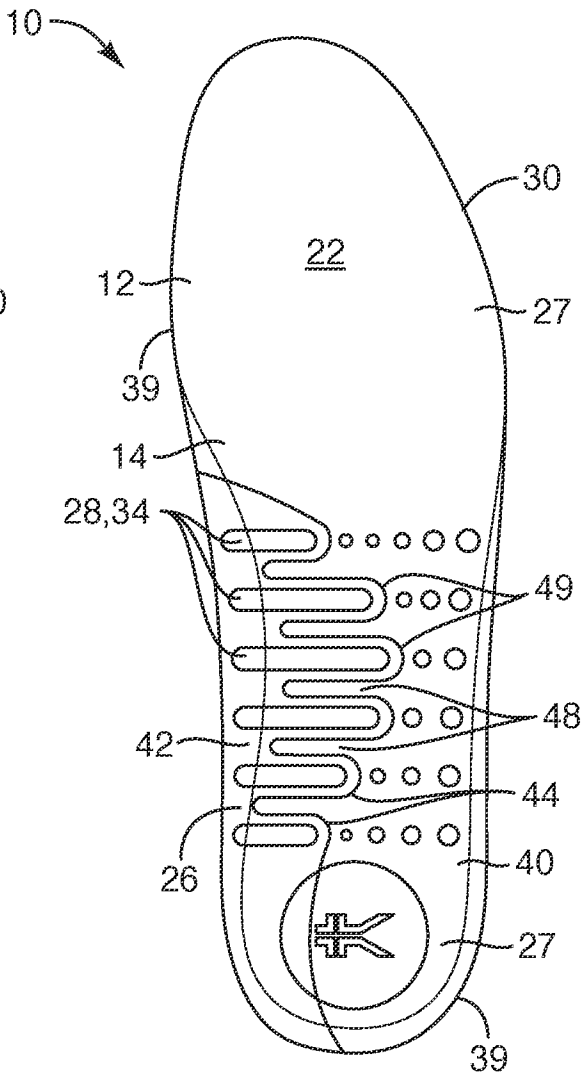
FIG. 16 is a bottom plan view of an alternative embodiment thereof in which the bulk region occupies less extent toward the lateral side (gaps are medially deeper) thereof while the projections or protrusions therefrom extend laterally farther.

Referring to FIG. 16, the continuous expanse 42 or bulk region 42 of the intermediate layer 26 may be reduced or increased in combination with the projections 44 or fingers 44 extended. In this situation, one may engineer the embossed regions 28 and debossed regions 32 of the fingers 44 in order to provide sufficient fat pad 64 containment laterally, and sufficient longitudinal flex in bending to aid the striding comfort of a wearer. The fingers 44 or projections 44 extend exclusively from the medial side of the sock liner 10, as depicted.

For example, age affects the thickness and the cushioning capacity of the fat pad 64 (fatty tissues) supporting the foot, here the calcaneus (heel) bone of a foot. Soft tissues cradle and otherwise support bone structures above them along with the muscles, tendons, and ligaments connected thereto. Thus, soft tissue can fill in regions where the fingers 44 are not, while the fingers 44 will themselves tend to impose themselves in a vertical and lateral direction against the base layer 22 and the foot portions thereabove. This embodiment relies on the soft tissue being deflected by the fingers 44 to contain the fat pad 64 and distribute the load from the bone into the base region 22. Such support of the foot may be substantial and may be engineered (tuned, adapted, calculated) to the comfort of a particular user.

As a practical matter, a combination of a number of intermediate layers 26 to be added can control thickness and stiffness. The length of the fingers 44 or projections 44 can control how far, how thick, and at what positions the fingers 44 may be present. Meanwhile, the transverse extent of the bulk region 42 as compared to the fingers 44 can determine how much feathering (transitioning, graduation) or reducing of density and support in the lateral direction in favor of softness may be done as the liner 10 progresses laterally from the medial side of the sock liner 10 toward the lateral side 56. Thus the precise locations, local density, local spring constant (stiffness), the amount of pressure, the vertical distance or thickness of augmentation between the foot with its sock and the insole may all be engineered with a great degree of precision for a particular foot.

Figure 32:
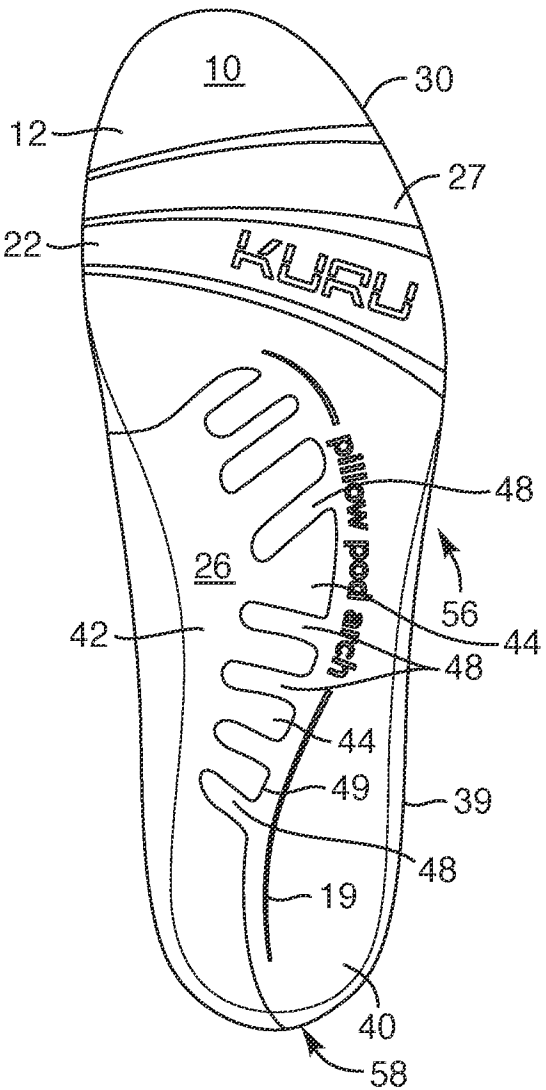
FIG. 32 is an inferior aspect, plan view of an alternative embodiment thereof in which the gaps between projections or protrusions extending from proximate medial side toward the lateral side thereof include additional gaps that are wider but shorter than certain alternative embodiments.

Referring to FIGS. 17 through 29, and extending in certain circumstances through FIG. 32, while continuing to refer generally to FIGS. 1 through 32, a sock liner 10 in accordance with the invention may use a different shape and extent for the projections 44 extending from the bulk region 42 of the sock liner 10. In this embodiment, each projection 44 of the intermediate layer 26 takes on a quasi-trapezoidal shape.

For example, each of the projections 44 longitudinally separated at least partially along its transverse direction from adjacent projections 44 suggests a somewhat triangular (3-sided) or truncated to be trapezoidal (4 irregular sides and angles) shape. This shape accommodates their convergence at the bulk region 42 toward the medial side of a foot. A shoe on that foot forms something of a shorter inside radius about a medial side of the arch region.

As the projections 44 extend somewhat radially 20*c* (laterally 20*c*) away in the lateral direction 20*c*, they expand or widen (in a longitudinal direction) to conform to the arch.

Figure 17:
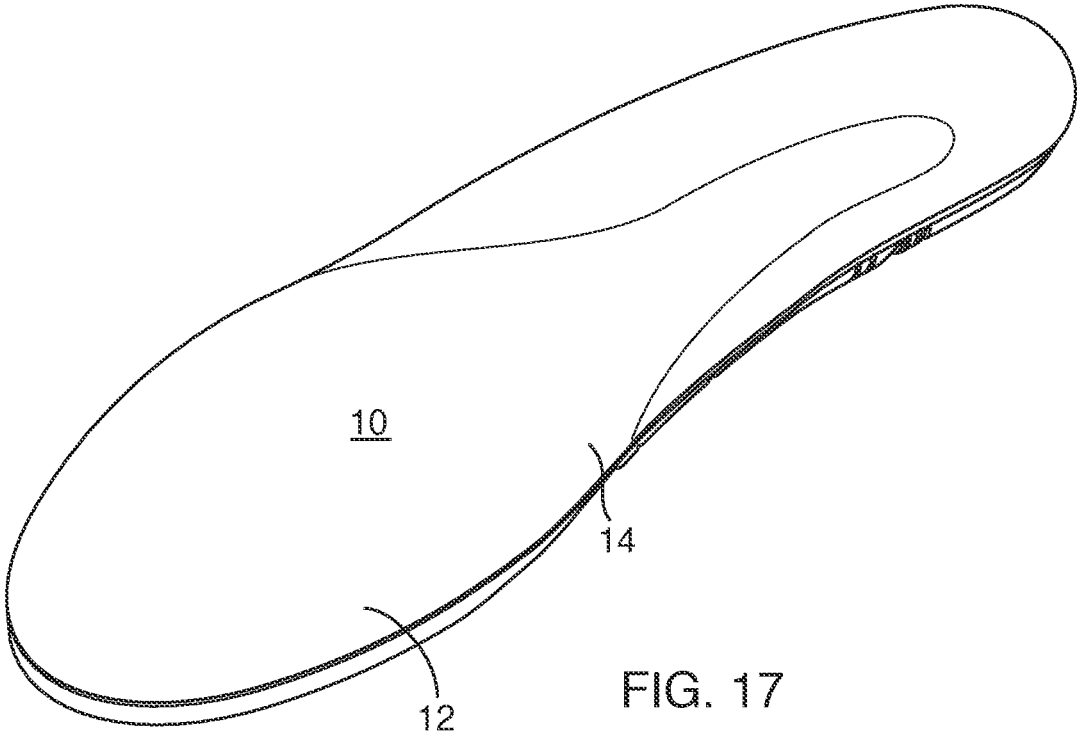
FIG. 17 is an upper perspective view of an alternative embodiment of an intermediate layer bonded to a base layer in a sock liner in accordance with the invention.

Referring to FIG. 17, the upper perspective view of the sock liner 10 is, of course, unremarkable with respect to previous embodiments hereinabove. The shoe and the foot are the same. Accordingly, the top surface 25 of the contact layer 24 is or can be the same.

Figure 18:
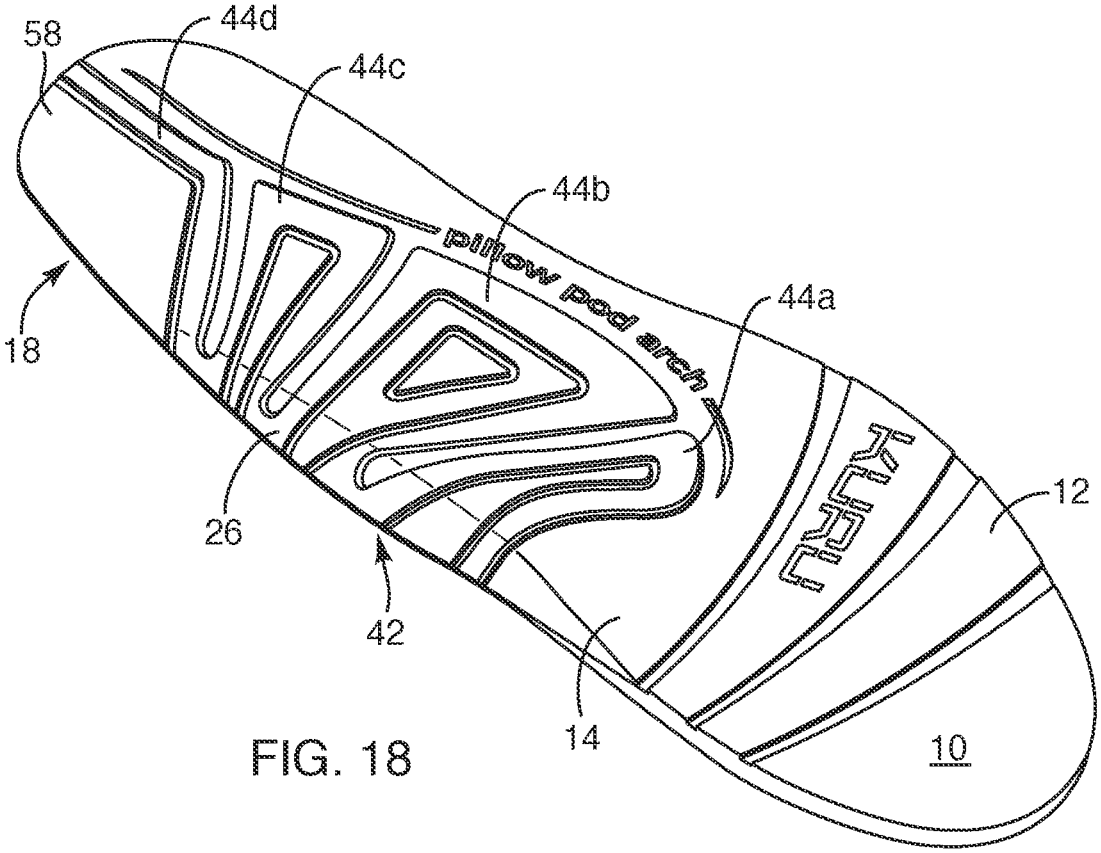
FIG. 18 is a lower perspective view thereof.

Referring to FIG. 18, a bottom perspective view of this embodiment of a sock liner 10 includes a base 22 just as in other embodiments, under which has been laid and bonded another intermediate layer 26. This intermediate layer 26 includes an ever so small metatarsal pad (comparatively with respect to the overall layer 26. In this embodiment, the bulk region 42 or the continuous and connected portion 42 is comparatively small when compared with that of the embodiment of FIGS. 1 through 16, and when compared with the lateral extent of the projections 44.

For example, the projection 44*a* extends somewhat under the metatarsal area at the forward (anterior) portion of the arch region 16. Meanwhile, the projection 44*b* extends directly under the arch region 16, and spreads longitudinally as it extends laterally. Meanwhile, the projection 44*c* extends under the posterior portion of the arch region 16. It in fact connects to a heel portion 44*d*. That is, it connects through the "bulk region 42" to a heel portion 18 or heel region 18 of the sock liner 10. This heel portion 18 is medially inward of the center of the heel portion 18 and alters any varus wedge 58 to favor the fat pad 64 support laterally.

A definition of varus may change depending upon the point of view and the role of a speaker, or writer, and whether the orientation refers to a member or a joint at an end of a member, or rather a surface. Herein, varus means the following: having an axis inward turning, that is, turning toward the medial plane of a body in descending from a superior to an inferior aspect or position. This means that a joint such as a leg or a foot, if it turns inward toward the medial plane of a body as it descends from an upper (superior) toward lower (inferior) regions thereof, is considered varus if it so turns. A varus plane has a "normal" (perpendicular) to the plane that is directed medially from superior to inferior.

Meanwhile, valgus indicates a tending or direction toward the lateral aspect of a body whether a joint, that would cant in that direction, a member such as a bone that would cant or turn or bend in that direction, or a surface that would tilt a normal (perpendicular to horizontal) from a vertical toward facing more outward, laterally when descending from superior to inferior.

It is not uncommon that a heel of a user may have a varus or a valgus tilt to it. It appears from certain literature that a varus turning may be more common. Accordingly, each of the sock liners 10 may include a varus wedge 58. This means, as pertains to this disclosure, that the wedge 58 supports a varus heel surface. A varus heel surface or the bottom, lower, inferior, plantar aspect of the heel faces somewhat inward.

In other words, a normal (perpendicular) to a plane on which that heel would rest in its varus orientation would cant inward in moving from a superior aspect to a lower aspect or from a superior position to an inferior position. This may correspond to a leg bone that is varus in orientation.

However, in an example, each of the sock liners 10 in FIGS. 1 through 16, as well as in FIGS. 17 through 32, includes a region of increased density, thickness, stiffness, or any combination thereof on the medial side (aspect). This urges the varus wedge portion 58 to be thicker. The insert's increase in density, stiffness, thickness, or the like on a medial side urge the fat pad 64 in a lateral direction.

From a medial side of the foot the insert 10 urges a Poisson deflection of the foot pad of the heel in a lateral direction by density and stiffness of the intermediate layer 26. Accordingly, any wedge 58 may be built up accordingly to shape the fat pad 64 in the heel region 18 of the sock liner 10.

Figure 19:
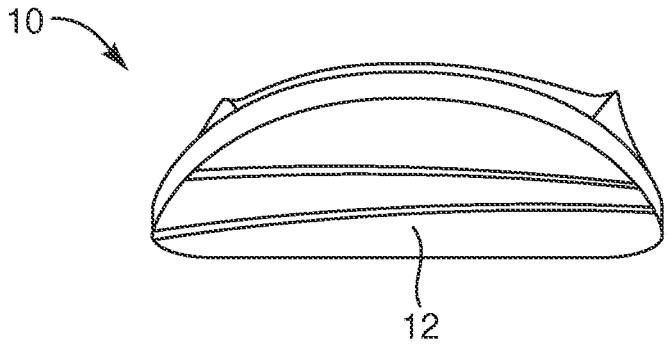
FIG. 19 is an anterior end elevation view thereof.

Referring to FIG. 19, the front elevation view (anterior aspect) is somewhat unremarkable and reveals only the profile.

Figure 20:
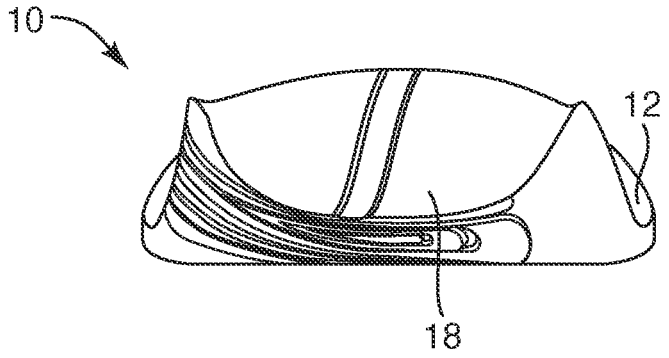
FIG. 20 is a posterior end elevation view thereof.

Referring to FIG. 20, similarly, the rear elevation view (posterior aspect) shows the general shape, in which the arch region 16 is prominent as it extends vertically higher than the heel region 18 of the sock liner 10.

Figure 21:
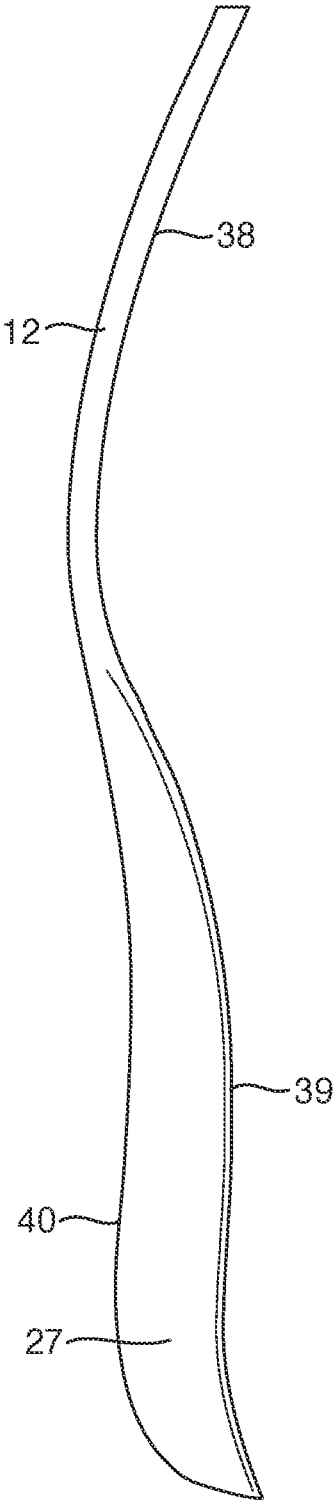
FIG. 21 is a lateral, side elevation view thereof.
Figure 22:
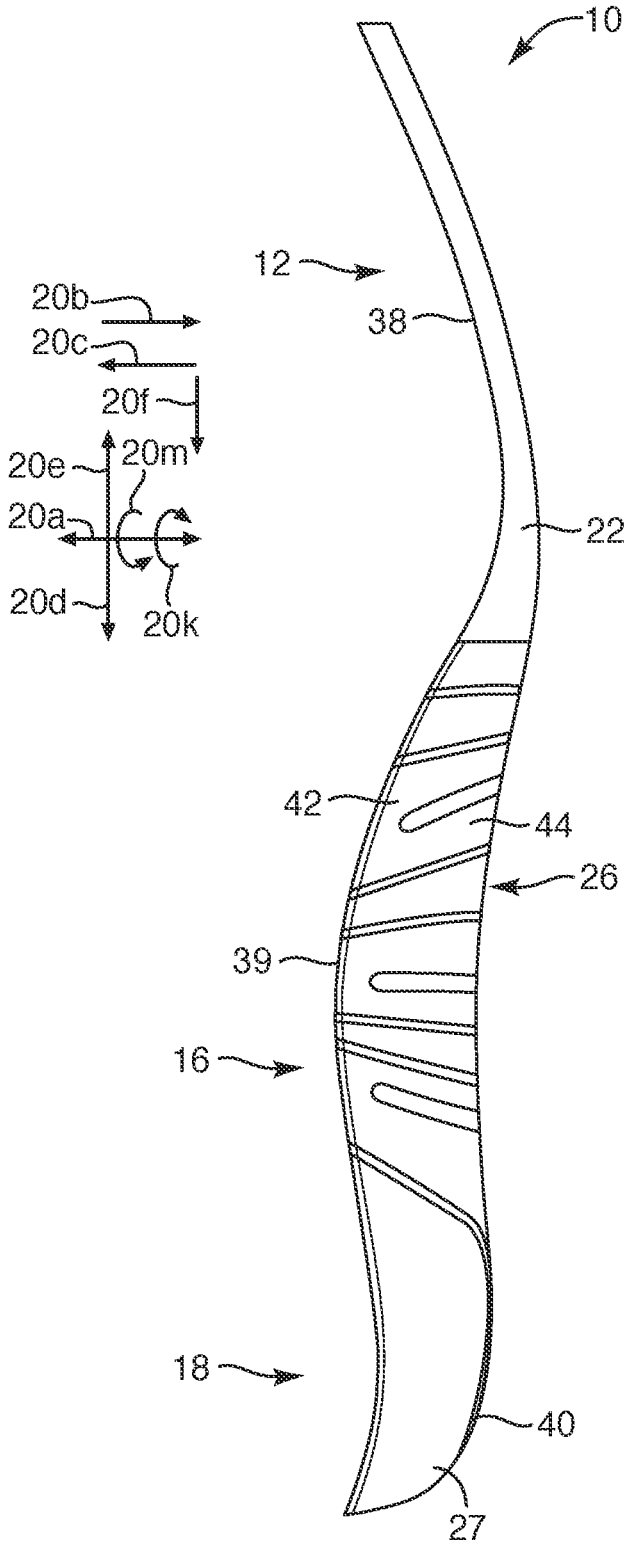
FIG. 22 is a medial, side elevation view thereof.

Referring to FIGS. 21 and 22, these lateral and medial elevation views, respectively, illustrate the edges 39 or periphery 39 of both the medial and lateral sides of the sock liner 10. On the one hand, the silhouette would be the same for either, but the medial elevation view of FIG. 22 illustrates that the arch portion 16 of the sock liner 10 rises substantially higher than does the lateral side of the sock liner 10.

Figure 23:
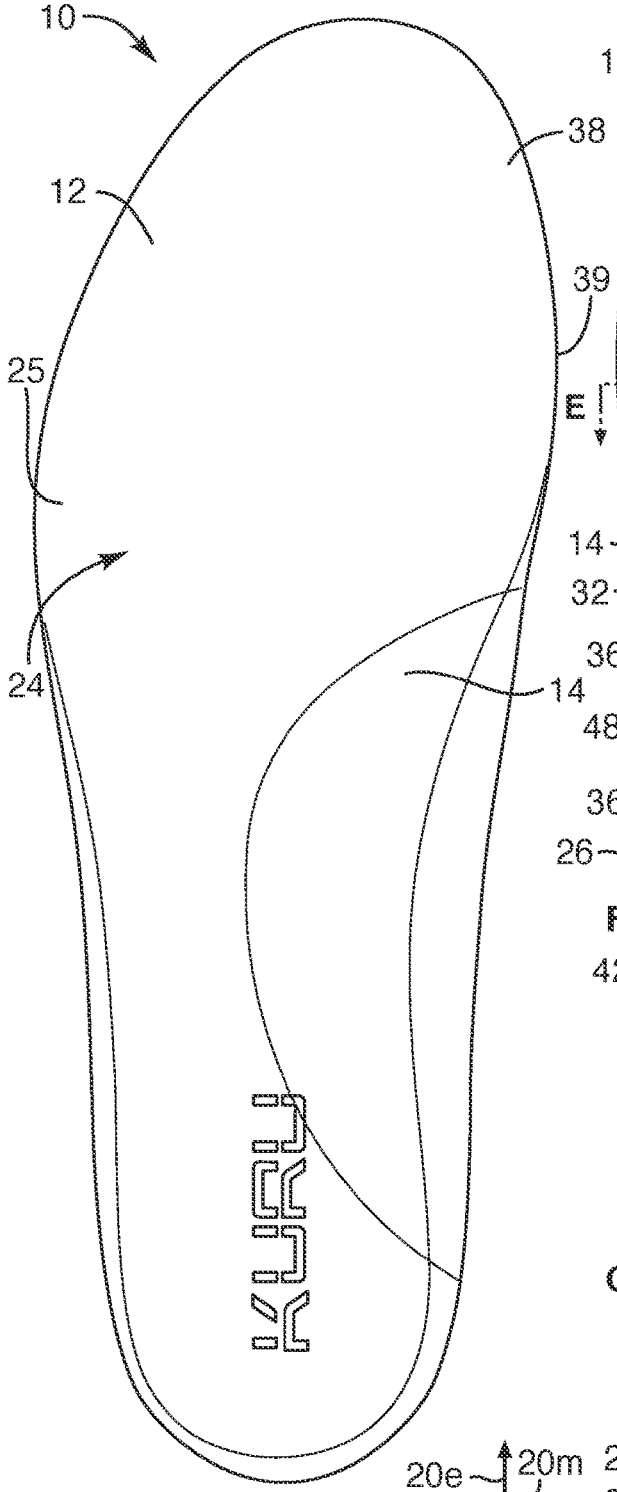
FIG. 23 is a superior aspect, plan view thereof.
Figure 24:
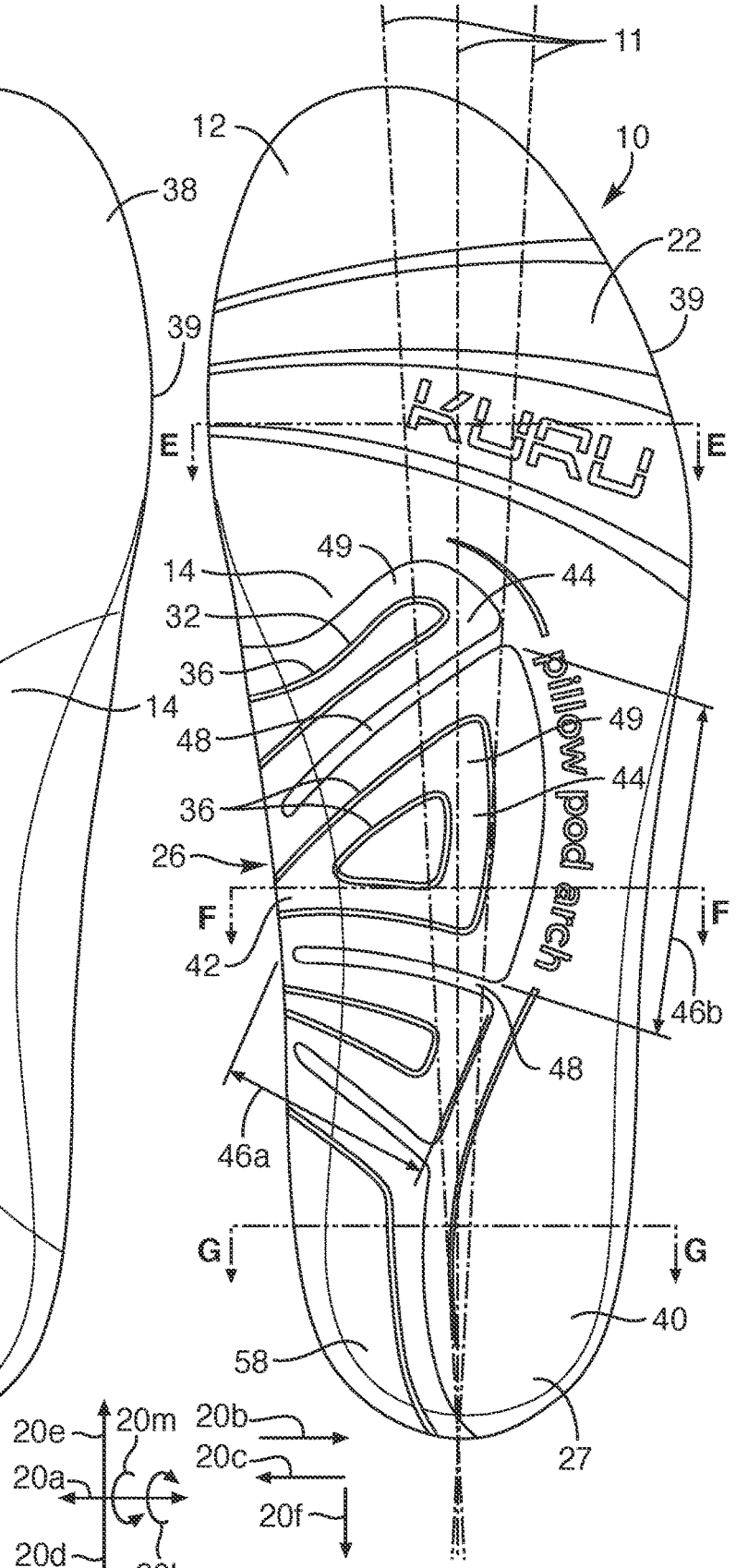
FIG. 24 is an inferior aspect, plan view thereof.
Figure 25:
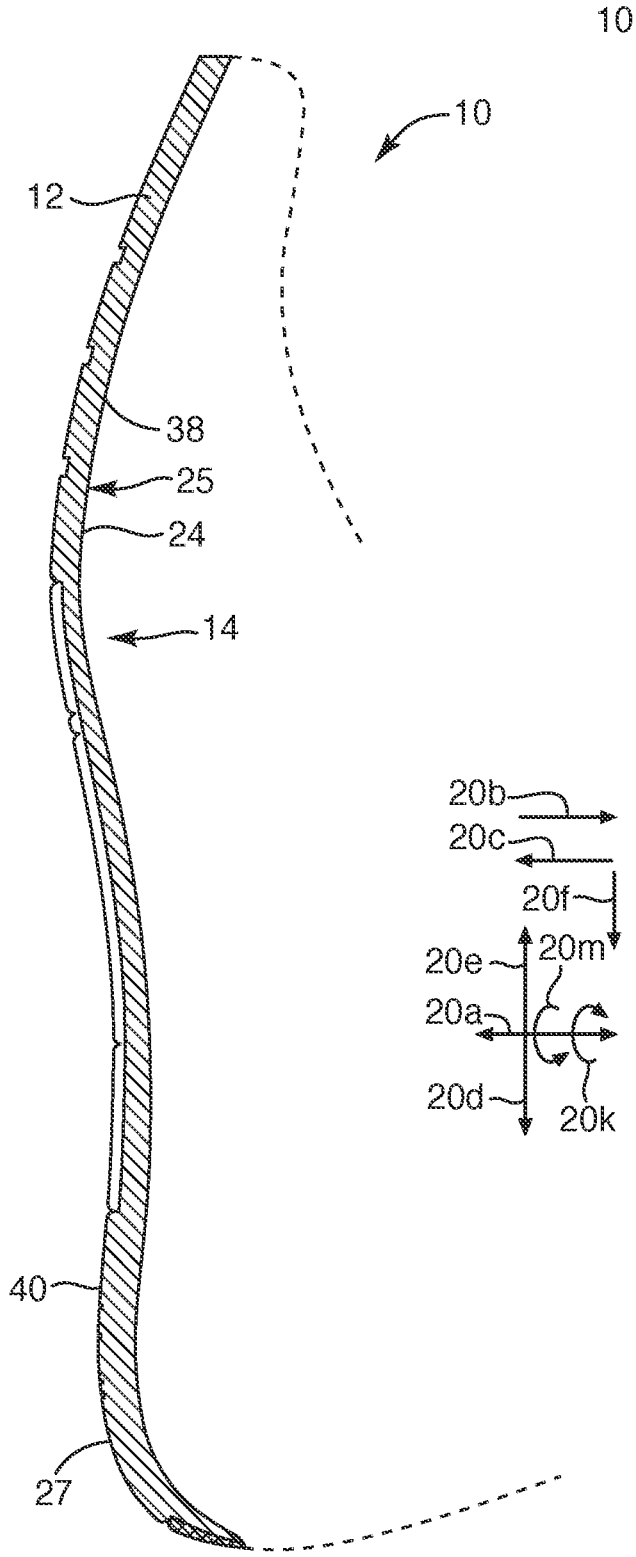
FIG. 25 is a lateral, side, cross-sectional elevation view thereof.
Figure 26:
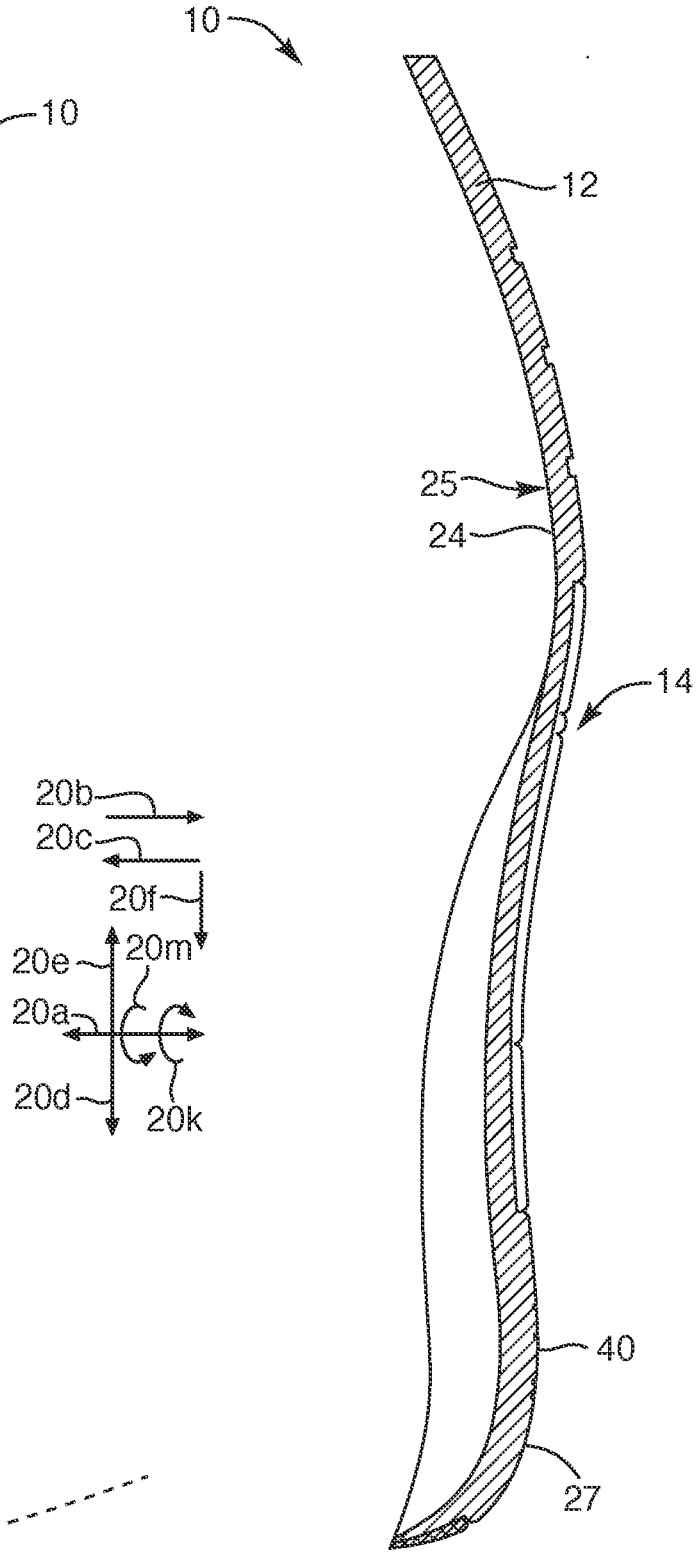
FIG. 26 is a right side, elevation, cross-sectional view thereof.

Referring to FIGS. 23 and 24, the top plan view (superior aspect) and bottom plan view (inferior aspect), respectively illustrate again the unremarkable top surface 25 of the contact layer 24 typically disposed across a top surface of the base 22. Meanwhile, the shape of the projections 44 and the varus wedge 58 figure prominently in this shape.

Each projection may be a separate piece with its own tailored mechanical properties as discussed hereinabove. It has been found that certain embodiments of the projections 44 may benefit little from mechanical connection to the bulk region 42 other than in manufacturing processes. A single piece is easier to place and "register" (fit, align) at a specific location. Thus, the manufacturing process may be greatly aided thereby.

In a manufacturing process the base layers 22 may be set into a mold, with a single piece of material serving for both the intermediate layers 26 for both the left and right foot. Thus, a press may then come down to close the mold and heat it in order to create any designs, any embossed areas 28, debossed curves 36, or debossed regions 32.

As discussed hereinabove, the debossed regions 32 or debossed curves 36 provide a certain amount of flex across them, while the thicker portions that are not debossed in the projections 44 maintain more softness by their added thickness and lower spring constant. Thickness is measured in the nominally vertical direction, but not absolutely.

For example, at any given location on the sock liner 10 thickness may be measured straight through in a direction normal (perpendicular) to a tangent plane to an upper surface 25 of the contact layer 24. Thus, thicknesses at any point may be specified in order to control stiffness, section modulus, softness, and resistance or compliance with bending forces. Those forces urge the sock liner 10 to conform to the bending of the shoe in the natural gait of a user progressing from heel strike to mid stride to toe off or push off while providing vertical and lateral stabilization of the fat pad 64.

Other design parameters available for controlling include the width (in a longitudinal direction 20*c*) along the surface of the projections 44 occupied by the debossed curves 36 compared to the remainder thereof. Similarly, the number of dividing gaps 48 or spaces 48 existing between adjacent projections 44 may be altered. In fact, the entire triangular or quasi-trapezoidal shape of each of the projections 44 may be altered by imposing an additional gap 48 running from lateral to medial starting near the lateral extremity of the projection 44.

The embodiment illustrated in FIGS. 17 through 29 may serve as a reference for comparison. For example, referring to FIGS. 25 and 26, cross-sectional views are taken, from the left or lateral side, since the illustration corresponds to a left foot, as in FIG. 25. Meanwhile, the right side elevation cross-section corresponding to the medial side of the sock liner 10. It shows the same profile along the sectioning line (longitudinal "axis") although there is not typically a straight line of as much interest as the curvatures and the load paths 19 or simply identified as the path 19 of force (vertical) progression along the foot during a gait cycle.

Figure 27:
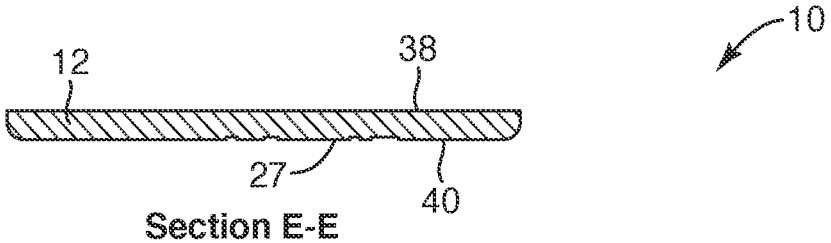
FIG. 27 is a posterior aspect, elevation, cross-sectional view thereof taken at section E-E.
Figure 28:
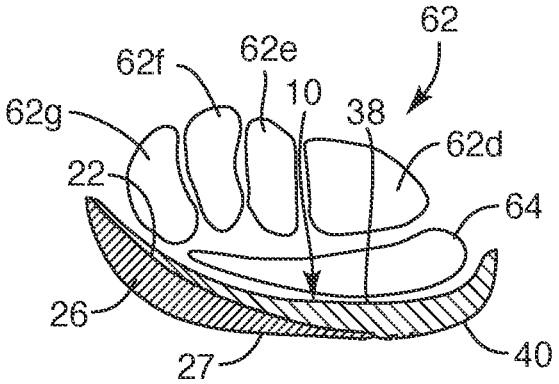
FIG. 28 is a posterior aspect, elevation, cross-sectional view thereof taken at section F-F, showing the relation of the foot bones bearing thereon.
Figure 29:
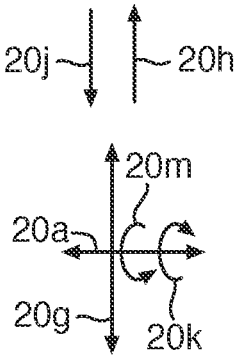
FIG. 29 is a posterior aspect, elevation, cross-sectional view thereof taken at section G-G showing the calcaneus bone bearing thereon.
Figure 29:
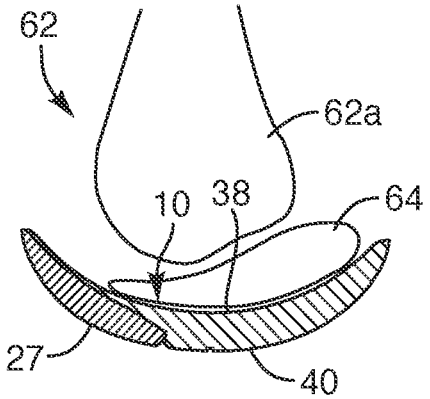

Referring to FIGS. 27 through 29, the front, end, elevation, cross-sectional view taken at section E-E is illustrated. Again, this is somewhat unremarkable as the sock liner 10 is not usually called upon nor relied upon to correct side-to-side fat pad 64 containment but longitudinal behind the ball in the forefoot region 12. This is partly because the metatarsals and phalanges are capable of substantial motion and undergo such motion in three dimensions of translation and three of rotation on a regular basis during the gait of an ambulatory (walking) subject.

In contrast, tremendous loads, including the entire body weight, pass directly through the leg bones (tibia and fibula) to the calcaneus bone as virtually "two-force members" (loaded only axially). Accordingly, any misalignment of forces between the bones of the foot, or any other soft tissue structures of the foot and the insole of a shoe must be dealt with, accommodated or relieved by containing the fat pad 64 by way of the sock liner 10. Accordingly, shaping may be done for this purpose. Meanwhile, much interest begins in the arch region 16 of the sock liner 10.

Referring to FIG. 28, the end elevation, cross-sectional view taken at section F-F is illustrated. The cuboid 62*d*, lateral cuneiform 62*e*, intermediate cuneiform 62*f*, and medial cuneiform 62*g* foot bones 62 are shown as they bear on the fat pad 64 and liner 10. The fat pad 64 is urged toward the space and softer region offered by the lateral aspect of the liner 10, thus providing containment of the fat pad 64, and improved cushioning of loading by the foot bones 62.

One immediately notes the rise as the thickness and therefore elevation of the sock liner 10 provide conformal support cradling the arch region 16. This is protecting an arch of a foot by adding distance and some comfortable stiffness for support and surface softness for load distribution as one may choose. A buildup of density in the medial aspect provides soft tissue (fat pad 64) capture (containment) to better support vertical loads on the lateral region of the foot. Sufficient softness will comfortably distribute loading from foot bones through the sock liner into the insole. This may be beneficially engineered along the entire length of the liner 10, between the insole and the foot, resting against the contact layer 24.

Referring to FIG. 29, the end elevation, cross-sectional view taken at section G-G is in the heel region 18, show the shape for containment of all soft tissue. The lateral 54 and medial 56 sides of the heel portion 18 both share similar thickness, altitudes, and relationship to the insole and the upper. The calcaneus bone 62*a* is shown above the fat pad 64, distorted by the stiffer medial portion of the liner 10 to increase bulk and cushioning of the foot bones 62 by the fat pad 64.

Figure 30:
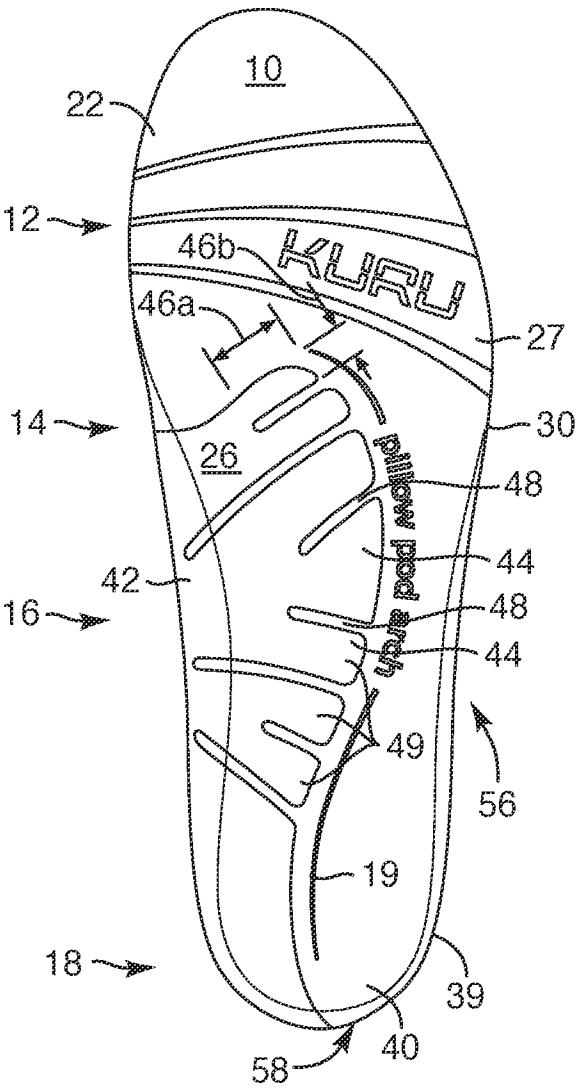
FIG. 30 is an inferior aspect, plan view of an alternative embodiment thereof wherein the intermediate layer has additional gaps formed between the supporting projections or protrusions extending from the medial side to the lateral side of a wearer.

Referring to FIG. 30, additional spaces 48, gaps 48, or slits 48 may be added within or between projections 44. Thus, each projection 44 may be further divided. In this illustrated embodiment, the spaces 48 extend from a lateral side to a medial side of the projections 44. Also, in alternative embodiments, the spaces 48 may extend medially deeper than the original spaces 48 in the sock liner 10. Variations like this provide design parameters to adjust relief, transition, and movement, by "fine tuning" the fat pad 64 containment along the full length of the foot.

Figure 31:
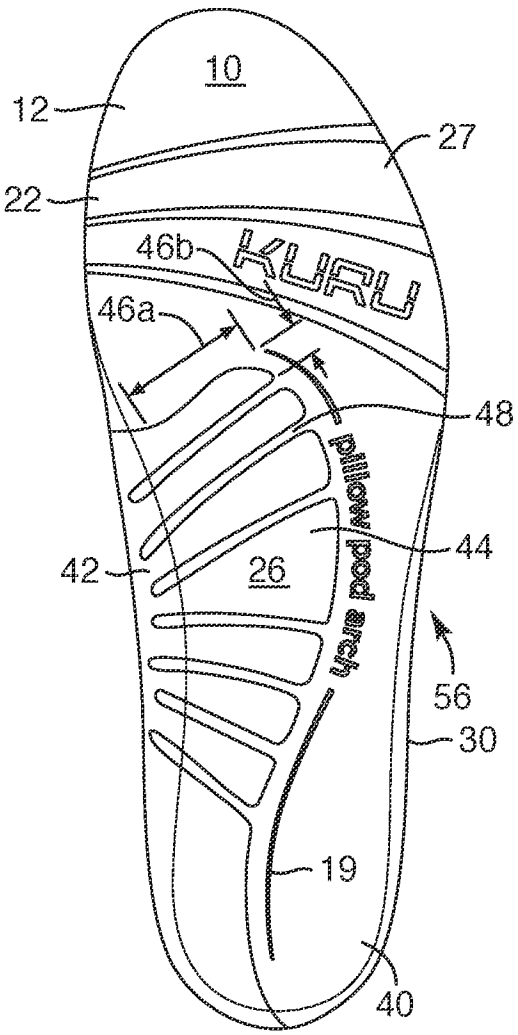
FIG. 31 is an inferior aspect, plan view of an alternative embodiment thereof in which additional new gaps are provided that extend an equal distance medially or toward the medial side of the sock liner in accordance with the invention.

Referring to FIG. 31, in yet another alternative embodiment, additional spaces 48 may be provided in the blanks, and therefore in the finished intermediate layer 26. In this respect, the embodiment of FIG. 31 begins to approach the embodiments of FIG. 16. Notwithstanding the projections 44 are somewhat more angular, manipulation of the dimensions of the spaces 48 along with the lengths 46 of the projections 44 may provide selectively more support, more softness, more cushioning, and more capture of the fat pad 64 under the loading path of the foot.

By capture is meant containment in a horizontal direction (typically medial to lateral, but sometimes longitudinally posteriorly toward the heel or anteriorly toward the ball of the foot) of soft tissue. This is done in order that the pad continue to bulk up under the harder bone structures thereabove and therewithin.

In this regard, it is important to remember engineering principles at play here. The conservation of mass says that a quantity of mass is not created nor destroyed. In the engineering of materials there is a principle applying conservation of mass, called the Poisson effect. The Poisson effect applies to all solid and quasi-solid materials. It need not apply directly to unrestrained liquids, because such liquids are free to move in any direction and are defined in terms of pressure and flow. Nevertheless, any solid-like material that is stressed (put under a force across an area, where stress is pressure, expressed as force per unit area) will respond.

The material may be Inconel™ moving so infinitesimally little as to be hardly detectable by the most sensitive instruments, to a very soft elastomeric material that may immediately squish out in one direction as soon as it is squished in from another orthogonal direction. Likewise, it will immediately draw in from one direction as soon as it is drawn out in any orthogonal dimension.

For example, applying a load (a force or a pressure) in one dimension will immediately cause a deflection in the direction of stress (pressure, force per unit area) that dimension. That deflection will be accounted for by additional deflections in the opposite sense in all directions orthogonal to the first. In lay terms that means that a block of the material, if squished on two of its opposing ends, will then puff out or expand out on all of its orthogonal sides. Similarly, if it is tensioned or stretched between two of its opposing ends it will immediately draw in and narrow on all of its sides orthogonal to the direction of the force.

As it affects the sock liner 10 in accordance with the invention, the illustrated embodiments will necessarily respond to the stress or pressure of a foot on the sock liner 10. That stress will be passed through the contact layer 24 to the base 22, and thence into any intermediate layer 26. The effect is mediating, mollifying, or otherwise altering the distribution of stresses passed into the intermediate layer 26.

Specifically, the projections 44 thereof will change the level of support and its softness or comfort level. Meanwhile, providing shapes that will tend to wrap upward and around the medial 54 and lateral 56 sides of the foot in any particular location, and most specifically near the arch 16, also gathers and maintains soft tissues around the bone structures, which may be supported thereby according to the Poisson effect.

Containment on the medial 54 and lateral 56 sides requires that. In response to lateral and medial containment stress, more stress will be carried underneath the calcaneus bone of the arch 16, for example.

Referring to FIG. 32, this also indicates that if one desires to not progress containment so far toward the lateral side 56 of the foot and the sock liner 10, shorter projections 44 between spaces 48 may be formed in the intermediate layer 26. Spaces 48 relative to the projections 44 may be comparatively larger or smaller according to the desired effect.

Here again, an engineering principle is at play in the design and tuning of a sock liner 10 with respect to a user. There exists another principle in engineering called St. Venant's principle. This principle was essential, even critical, to stone structures developed thousands of years ago. The concept of the arch, the concept of a stone or masonry wall have absolutely relied upon this principle of St. Venant.

The St. Venant principle is that stress distributes along principal shear lines. Those principal shear lines in a homogenous material will extend from the point of original loading (stress) outward (away) at a 45 degree angle in each direction away from the point of applied stress. This means that a wall can be built and any individual brick is supported not just by the brick below it but by bricks beside it, outward at a 45 degree angle.

Thus, an arch can be built because force can be transferred according to St. Venant's principle from a keystone supporting stonework or brickwork above it into vertically and horizontally adjacent stones, all of which are tapered, and on down through the arch until the arch terminates on top of a fully, vertically supported pillar or wall. St. Venant's principle applies to all homogenous materials.

Thus, force does not distribute straight downward. It immediately "radiates" from the point of load (and again "load" means a "force" or a "stress" in engineering terminology as known by a technician skilled in the mechanical arts). Stress distributes at that 45 degree angle.

This is why any intermediate layers 26 are always located below the base 22. It is not absolutely imperative that the intermediate layers 26 be always on the inferior surface or aspect of the base 22. However, if they are not, then they are exposed directly to the foot and vice versa. The foot is exposed directly to them. Accordingly, their mutual capacity for absorbing and also supporting and therefore returning stress is directly contacting the foot or at least to the very comparatively thin contact layer 24 against the foot. Thus, more local discomfort may arise. By having the base 22 superior (in operation, not construction as on a last) to the intermediate layer 26, St. Venant's principle will distribute loading and increase comfort.

By laying up the intermediate layers 26 under the base layer 22, St. Venant's principle is at work so that stress that would be passed from the insole up through the projections 44 of the intermediate layer 26 is now distributed therefrom through the thickness of the base layer 22 at that 45 degree angle.

Again, these concepts of St. Venant's principle, the Poisson effect, and so forth are used to engineer the relative widths along the longitudinal direction 20*d* of the projections 44 and their intermediate spaces 48. They also apply to the relative lengths 46 of the projections 44 and the spaces 48, where length of the projections 44 and the spaces 48 may effectively traverse a horizontal, transverse, medial and lateral directionality.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of manufacturing a sock liner capable of and effective at shaping a fat pad existing as an under portion of a foot of a user upon placement under the foot of the user in footwear, the method comprising:

providing a shape for a base layer capable of supporting a vertical force applied by an effective weight of the user during a gait cycle of the user in a longitudinal direction extending from an anterior side to a posterior side, in a transverse direction extending from a medial side to a lateral side, and in a vertical direction extending from a superior side to an inferior side;

forming a base layer operable as a base extending longitudinally, continuously from a forefoot region of the base, capable of supporting a forefoot of the user, through a midfoot region, capable of supporting metatarsals and an arch of the foot of the user, to a heel region capable of supporting a heel of the user; and forming an intermediate layer, inferior to the base, capable of fitting between an insole of a shoe and the base layer, wherein the intermediate layer is formed of a material having a greater density than that of the base layer at a location of the base layer in a lateral, posterior portion of the heel region, which is therefore softer than the intermediate layer medially adjacent the base layer's lateral, posterior portion of the heel region, and comprising a plurality of projections, spaced apart in the longitudinal direction and extending laterally from exclusively a medial side of the base and having no projections from a lateral side of the base, and the plurality of projections are each formed of a material selected and configured to have a density, length, and spring constant, individually determined for each of the plurality of projections and the projections are configured in length transversely, width longitudinally, density, and material composition, individually, based on a type of foot strike of a user corresponding to the sock liner;

wherein the plurality of projections includes a first projection of the sock liner, extending laterally, and exclusively from a medial side, capable of shaping the fat pad toward a lateral direction supporting a heel bone structure corresponding to the heel, and a second projection extending exclusively from a medial side of the base and laterally under the midfoot region and shaped to shape a midfoot portion of the fat pad in a lateral direction and under a midfoot bone structure of the user, corresponding to a lateral aspect of the midfoot region, wherein at least one of the first projection and the second projection extends beyond a longitudinal axis of the base.

2. The method of claim 1, wherein the plurality of projections are configured to increase a thickness of the fat pad.

3. The method of claim 1, wherein the intermediate layer comprises a bulk region and the plurality of projections extending from the bulk region, spaced from one another, including the second projection so located as to increase support of metatarsals of the user by urging the fat pad laterally.

4. The method of claim 1, wherein a projection of the plurality of projections comprises:

a rim constituting a debossed region formed by debossing the intermediate layer; and a boss surrounded by, and thicker than, the rim, the boss having a lower density and smaller spring constant compared to the rim.

5. The method of claim 1, wherein the plurality of projections each comprise:

a rim debossed into the intermediate layer; and a boss extending from and surrounded on its own lateral, anterior, and posterior edges by the rim, the rim having a higher density, less thickness, and greater spring constant, compared to the boss of greater thickness and having a lower density and smaller spring constant compared to the rim.

6. The method of claim 1, wherein the plurality of projections comprise at least one projection extending laterally from a medial side of the midfoot region to be capable of urging the fat pad under the arch in a lateral direction during a portion of a gait cycle of a user.

7. The method of claim 1, wherein the plurality of projections comprise at least one projection capable of being positioned posterior to the ball of a foot and effective to urge the fat pad anteriorly toward the ball of the foot during a gait cycle of a user.

8. The method of claim 1, wherein the plurality of projections:

each extend at least laterally from a medial side of the midfoot region;

when in use, urge the fat pad of the user in the midfoot region laterally as cushioning under a lateral portion of an arch of the foot of the user;

when in use, urge the fat pad in the forefoot region anteriorly as a support for a ball of the foot;

when in use, urge the fat pad in the heel region at least one of posteriorly and laterally as a support for the heel of the foot; and are longitudinally discontinuous from each other at a lateral extreme of the projections, individually continuous in a lateral direction.

9. The method of claim 1, wherein:

the midfoot region of the base layer comprises pedestals extending from the midfoot region and covering less than half of its surface area;

the first projection is shaped to urge the fat pad of a foot of the user, laterally by extending in a lateral direction; and the intermediate layer is selected to rely on a conservation of mass and Poisson effect to urge the fat pad on the bottom of the foot of a user to remain in place rather than distort in response to force applied during and due to the gait cycle of the user.

* * * * *